US007183035B2

(12) United States Patent
Tomoyori

(10) Patent No.: US 7,183,035 B2
(45) **Date of Patent: *Feb. 27, 2007**

(54) IMAGE FORMING METHOD

(75) Inventor: Kageyuki Tomoyori, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 331 days.

This patent is subject to a terminal disclaimer.

(21) Appl. No.: 10/802,452

(22) Filed: Mar. 17, 2004

(65) Prior Publication Data

US 2005/0208415 A1 Sep. 22, 2005

(51) Int. Cl.
*G03G 13/01* (2006.01)

(52) U.S. Cl. ..... 430/120; 430/125; 430/127; 430/110.4

(58) Field of Classification Search ..... 430/120, 430/125, 127, 110.4
See application file for complete search history.

(56) References Cited

U.S. PATENT DOCUMENTS

| | | | | |
|---|---|---|---|---|
| 5,840,461 | A * | 11/1998 | Haneda et al. | 430/133 |
| 5,888,684 | A * | 3/1999 | Kobayashi et al. | 430/65 |
| 5,953,562 | A | 9/1999 | Kawaguchi et al. | |
| 6,689,522 | B2 * | 2/2004 | Yamazaki et al. | 430/45 |
| 6,902,856 | B2 * | 6/2005 | Matsushima et al. | 430/45 |
| 2003/0190547 | A1 | 10/2003 | Kobayashi et al. | |
| 2005/0202333 | A1 | 9/2005 | Tomoyori | |
| 2005/0202334 | A1 | 9/2005 | Oshlba et al. | |

FOREIGN PATENT DOCUMENTS

| | | |
|---|---|---|
| JP | 06-180511 | 6/1994 |
| JP | 09-218532 | 8/1997 |
| JP | 10-111582 A | 4/1998 |
| JP | 11-160901 | 6/1999 |
| JP | 11-174787 | 7/1999 |
| JP | 2001-083716 | 3/2001 |
| JP | 2001-125315 A | 5/2001 |
| JP | 2001-215737 | 8/2001 |
| JP | 2001-296684 | 10/2001 |

* cited by examiner

*Primary Examiner*—Mark A. Chapman
(74) *Attorney, Agent, or Firm*—Lucas & Mercanti, LLP

(57) ABSTRACT

An image forming method having: developing a latent image formed on a cylindrical electrophotographic photoreceptor having a cylindricity of 5 to 40 μm, with a developer comprising a toner which comprises a ratio Dv50/Dp50 of a 50% volume particle diameter Dv50 to a 50% number particle diameter Dp50 of 1.0 to 1.15, a ratio Dv75/Dp75 of a cumulative 75% volume particle diameter from a largest volume particle diameter Dv75 to a cumulative 75% number particle diameter from a largest number particle diameter of Dp75 of 1.0 to 1.20, and toner particles having a particle diameter of 0.7×Dp50 or less in an amount of 10 percent by number or less.

14 Claims, 6 Drawing Sheets

IMAGE FORMING METHOD

BACKGROUND

1. Technical Field

The invention relates to an image forming method for use in an electrophotographic copying machine or printer.

2. Related Art

In recent years, as a result of the modern progress of digital image processing techniques, digital image formation has become a mainstream of image forming methods. In the digital image forming method, basically, images comprised of minute dots of, for example, 400 dpi (dots per inch; the number of dots per 2.54 cm) are developed. Thus, high image quality techniques capable of faithfully reproducing such minute dot images are needed. Especially, in recent years, demands for compactness, higher resolution and full color image formation of copying machines and for improved resolution of printers have increased. In case higher accuracy such as high resolution is needed, further improved image quality techniques are also demanded.

With a view toward realization of such high image quality, studies have been made on reduction of the particle diameter of toner while controlling the shape factors and the particle size distribution thereof. In particular, an attempt has been made to reduce the toner particle diameter while narrowing shape distribution and particle size distribution of the toner for the purpose of realizing improved resolution and precise reproduction of fine half tone images, thereby realizing an improved image quality. However, the intended high quality images are not obtainable in practice by using small diameter toner. Rather, some problems result from the use of small diameter toner. A problem in cleaning is one of them. Since the apparent adhesive force of such small toner onto a photoreceptor increases, it is difficult to clean the photoreceptor. In particular, since the toner obtained by emulsion polymerization method or suspension polymerization method effective to prepare small diameter toner has not only a small particle diameter but also a high particle roundness. Therefore, in the cleaning-process for cleaning the photoreceptor with a cleaning blade, toner particles remaining on the photoreceptor have a tendency to pass through between the photoreceptor and the edge of the cleaning blade to cause cleaning failure.

In order to solve the above problems, it is important that processing units constituting an electrophotographic image forming apparatus should have high accuracy. Especially, it is required that the positional relationship between the surface of a photoreceptor and each of a developing section, a transfer section and a cleaner should be strictly maintained. Displacement from the original relationship of those positions is apt to causes the following image defects:

(1) A positional displacement between the photoreceptor and the exposing section causes a reduction of resolution due to a focal offset of a laser beam;

(2) A positional displacement between the photoreceptor and the developing section (Dsd) causes fogs, a reduction of the image density and a reduction of resolution;

(3) A positional displacement between the photoreceptor and the transfer section causes a reduction of the image quality such as thin spots and blurs of the transferred image; and (4) A positional displacement between the photoreceptor and the cleaning blade involves a variation of the blade pressure, causing a cleaning failure and reduction of durability of the photoreceptor.

As described above, it will be understood that the above positional displacement between the photoreceptor and the image forming members around the photoreceptor significantly adversely affects the image quality of the electrophotographic image and also one of the factors for defining such positional relationship is positional accuracy of the photoreceptor.

SUMMARY

In accordance with a first aspect of the present invention, the image forming method comprises:

developing a latent image formed on a cylindrical electrophotographic photoreceptor having a cylindricity of 5 to 40 μm, with a developer comprising a toner which comprises a ratio Dv50/Dp50 of a 50% volume particle diameter Dv50 to a 50% number particle diameter Dp50 of 1.0 to 1.15, a ratio Dv75/Dp75 of a cumulative 75% volume particle diameter from a largest volume particle diameter Dv75 to a cumulative 75% number particle diameter from a largest number particle diameter of Dp75 of 1.0 to 1.20, and toner particles having a particle diameter of 0.7×Dp50 or less in an amount of 10 percent by number or less.

Accordingly, the shape and the particle size distribution thereof may be controlled, and high quality electrophotographic images may be provided even when using toners with reduced particle diameter.

DETAILED DESCRIPTION

Figure 1:
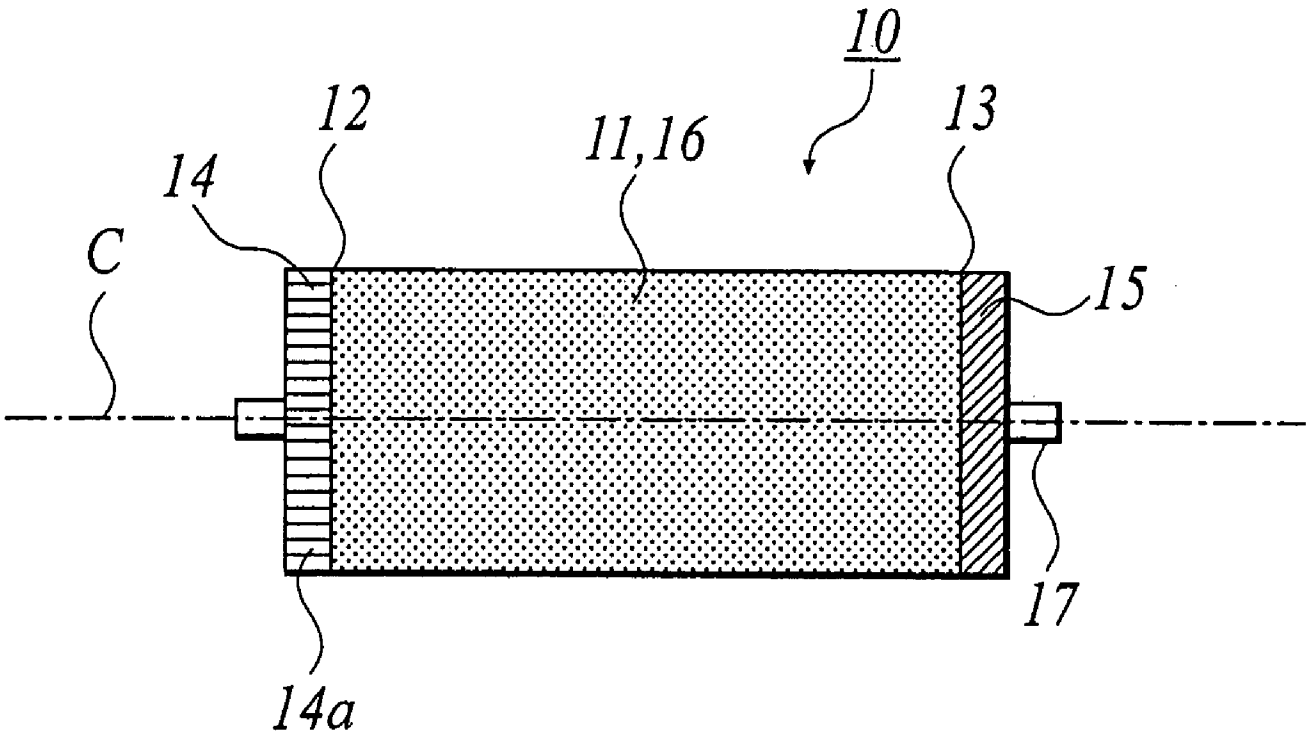
FIG. 1 is a schematically front view illustrating one example of photoreceptor according to the invention.

The invention will be hereinafter described in detail below.

Cylindricity is defined by JIS B0621-1984. The cylindricity represents a distance between a first geometrically correct cylinder inscribed coaxially therewith in a sample cylinder to be measured and a second geometrically correct cylinder circumscribed coaxially therewith about the sample cylinder such that the distance is minimum. The distance is measured in the radial direction of the sample cylinder.

That is, the term "cylindricity" is as defined in JIS B0621-1984 and represents a difference of radii between a geometrically correct cylinder inscribed in a cylindrical substrate coaxially therewith and a geometrically correct cylinder circumscribed about the cylindrical substrate coaxially therewith in case that the space between the two geometrically correct cylinders are minimum. The difference between radii is represented in the unit of μm. In other words, the cylindricity is indicated as a difference between radii of a maximum circumscribed diameter and a maximum circumscribed diameter.

The cylindricity of the cylindrical electrophotographic photoreceptor (hereinafter referred as "electrophotographic photoreceptor" or "photoreceptor") should be 5 to 40 μm, preferably 7 to 30 μm, and more preferably 7 to 27 μm. A cylindricity of the photoreceptor between 5 to 40 μm can protect from the above-described defects (1) to (4). A cylindricity of less than 5 μm is disadvantageous from the standpoint of costs, because the yield of the photoreceptor is low. The cylindricity of the electrophotographic photoreceptor means the cylindricity of the portion which is substantially utilized for forming images. Thus, the portions adjacent to both edges of the electrophotographic photoreceptor in which an image formation is not performed and the thickness of the photosensitive layer varies are not taken into account.

The cylindricity is determined by measuring the roundness at each of the seven positions including a midpoint, two positions spaced a distance of 10 mm from opposite ends, and four intermediate positions determined by dividing a distance between the midpoint and each end into 3 divisions, using a non-contact universal roll diameter measuring device (available from Mitsutoyo Co., Ltd.).

The term "inlay process" as used herein means cutting the inside of the cylindrical substrate to form a machined surface such as a step (for the purpose of attaching a member). For example, while rotating the cylindrical substrate, a cutting bite is fed in the inside periphery of the cylindrical substrate and is fed in the axial direction to form a step.

In the invention, since the inlay process is mainly for the purpose of forming a step in each of the opposite end portions of the cylindrical substrate for fitting flanges in respective steps, steps having a length of d mm (the inlay length of the invention) in the axial direction of the cylindrical substrate are formed at both ends of the cylindrical substrate.

The axial length D(mm) of the supporting member is preferably within the following range:

$$\frac{1}{2}\times L \leqq D < (L-2d)$$

wherein L is the length (mm) of the cylindrical substrate (axial direction). When the length D is smaller than ½×L, the both ends of the cylindrical substrate are apt to spin so that accuracy in machining cannot be achieved. When D is (L−2d) or more, a sufficient space for the inlay process is not feasible so that it becomes difficult to perform the inlay process.

The supporting member in this invention is intended to refer to a member inserted to press fit into the internal bore of the cylindrical substrate, thereby preventing the vibration and deformation of the cylindrical substrate while the cylindrical substrate is machined, such as the inlay process or the like.

The outside diameter reference in this invention means that the center axis of the outer cylindrical surface of the cylindrical substrate shall be the reference axis.

The inside diameter reference for the inlay processed portion in this invention means that the center axis of the inside cylindrical surface formed by the inlay process shall be the reference axis.

The invention will now be described in detail below with reference to the accompanying drawings.

FIG. 1 is a schematically front view, illustrating an electrophotographic photoreceptor 10, which comprises a cylindrical substrate 11 and flanges 14, 15 provided at opposite ends 12, 13, respectively, of the cylindrical substrate 11. A photosensitive layer 16 is formed over an outer peripheral surface of the cylindrical substrate 11. The electrophotographic photoreceptor 10 has a center line along which a shaft 17 is disposed in conformity with the axis C of the cylindrical substrate 11 so that the photoreceptor 10 is rotatable about the axis C.

The cylindrical substrate 11 is made of a conductive metal such as aluminum or an aluminum alloy and defines a hollow cylindrical space therewithin. The cylindrical substrate 11 of, for example aluminum alloy may be formed into a cylindrical shape by a drawing or a cutting process.

The flanges 14, 15 which are in the form of discs are fitted into opposite end portions of the cylindrical substrate 11 and each provided with a bore 18 at the center thereof. One flange 14 has a geared periphery 14*a* for use in control of the rotation of the photoreceptor 10.

The bar like shaft 17 is preferably made of an undeformable material, such as, a metal or plastic, and has a rectangular (e.g. square), circular or cross-shaped cross section. The shaft 17 is passed through the bores 18 formed in the flanges 14, 15 and fixed for bearing the electrophotographic photoreceptor 10 for rotation.

The photosensitive layer 16 comprises a photoconductive material exhibiting a photoelectric effect and may be, for example, an organic photoconductive layer (OPC).

In order to produce the electrophotographic photoreceptor of the invention, it is necessary first to prepare the cylindrical substrate 11 having a cylindricity of 5 to 40 μm.

Figure 2A:
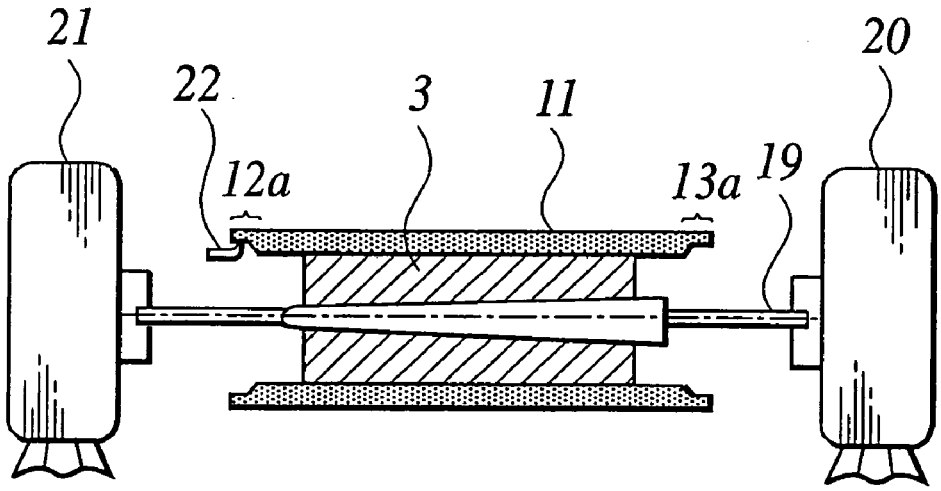
FIGS. 2A and 2B show the manufacturing processes of a cylindrical substrate in order.
Figure 2B:
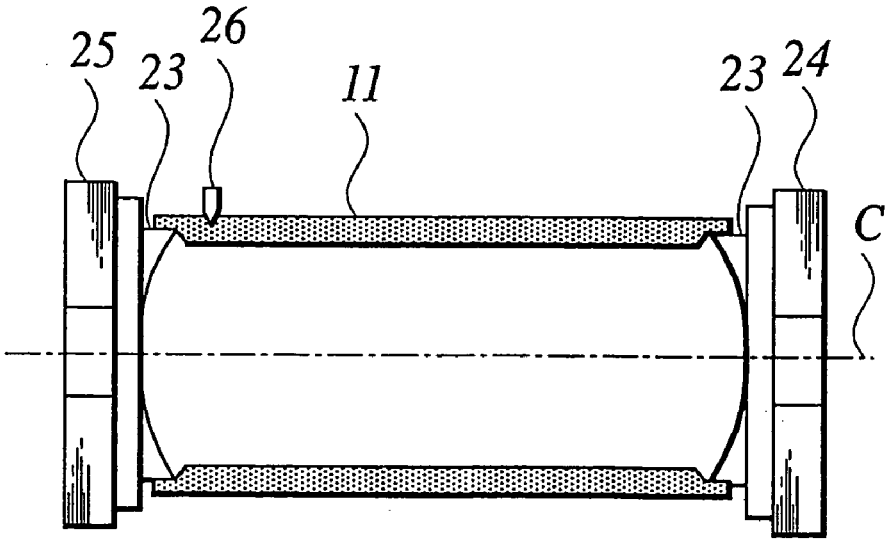

FIGS. 2A and 2B illustrates the manufacturing processes of a cylindrical substrate according to the invention in order. First, a cylindrical substrate 11 as shown in FIG. 2A is provided. The cylindrical substrate 11 may be, for example, an aluminum alloy cylinder having an outer diameter of 100 mm and a wall thickness of 2 mm which is formed by a drawing process.

FIG. 2A shows a process in which a supporting member 3 is inserted into the cylindrical substrate 11 and is being cutting with a bite for the inlay process. At each inside wall of the opposite end portions, a step is given by the inlay process, thereby forming thin wall portions (inlay processed portion) 12*a*, 13*a* having the same outside diameter as they were, while the thickness is made smaller by the thickness of the step, that is, the inside diameter becomes larger.

In the inlay process, while the cylindrical substrate 11 is supported from inside by the supporting member 3 and the pressure controlling section 4, the cylindrical substrate is rotated about the center shaft 19 which extends through the supporting member by the motors 20, 21. A cutting bite 22 is displaced while contacting with the inside of the cylindrical substrate, thereby performing the inlay process. Because the cylindrical substrate 11 is supported from inside during the inlay process, there is no fear of injures of the outer surface of the cylindrical substrate 11.

The cylindrical substrate 11 having the inlay process is then subjected to machining to cut the outer peripheral surface thereof. In FIG. 2A, the cylindrical substrate is held at inlay portions formed at both ands thereof by a pair of releasable holding pawls 23 of a non-sliding chucks 24, 25 (e.g. AIR BALLOON CHUCKS or KRAFTGRAPHY manufactured by Fujii Seimitsukogyo Co, Ltd; DIAPHRAGM CHUCKS manufactured by Dynamic Tool Co., Ltd.) and the peripheral outer surface of the cylindrical substrate 11 is machined with the inside diameter reference.

By adapting the above process method for the cylindrical substrate, the cylindrical substrate 11 for the electrophotographic photoreceptor having a cylindricity of 5 to 40 μm can be prepared. Reference numeral 26 denotes a cutting bite.

Figure 3A:
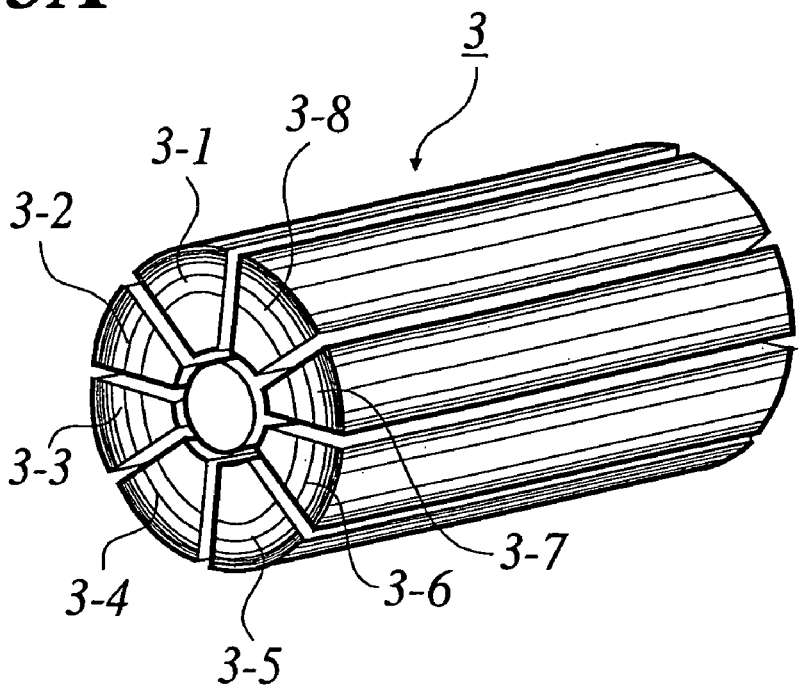
FIG. 3A is a perspective view showing a supporting member.
Figure 3B:
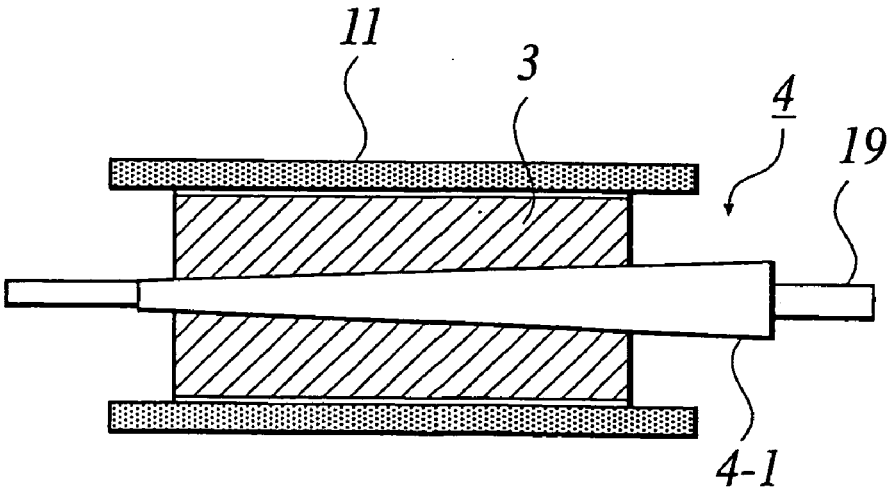
FIG. 3B is a sectional view showing a pressure controlling means for a supporting member.

The supporting member is preferably made of a high strength and high rigidity material, such as a metal (e.g. stainless steel or brass) or a ceramic for reasons of prevention of vibration and deformation of the cylindrical substrate during the inlay process. It is also preferred that the supporting member be provided with sections for controlling the contact pressure. A method of inserting and pressing the rigid member against the inside surface of the cylindrical substrate will be described as follows:

FIG. 3A is a perspective view of the supporting member 3. FIG. 3B is a sectional view of the pressure variable section 4 of the supporting member. In this embodiment, the supporting member 3 is composed of sections 3-1 to 3-8 each of which has a sector-shaped cross-section and which are interconnected to each other by resilient members such as springs (not shown). The outside periphery of the supporting member 3 is cylindrical so as to contact the inside cylindrical periphery of the cylindrical substrate. At the central portion of the supporting member, as shown in FIG. 3B, there is formed a central bore for putting in and out a center rod 41 having a taper. As shown in FIG. 3B, insertion of the center rod 41 forces the supporting member to expand outwardly and thus the cylindrical substrate is held while it is pressed. The contact pressure upon pressing can be controlled depending on the axial displacement of the center rod 4-1.

Alternatively, the supporting member 3 may be formed of a resilient material such as a hard urethane resin or a rubber.

The center rod 4-1 has a center axis 19 passing through the supporting member, about which the cylindrical substrate is rotated for inlay process.

Figure 4:
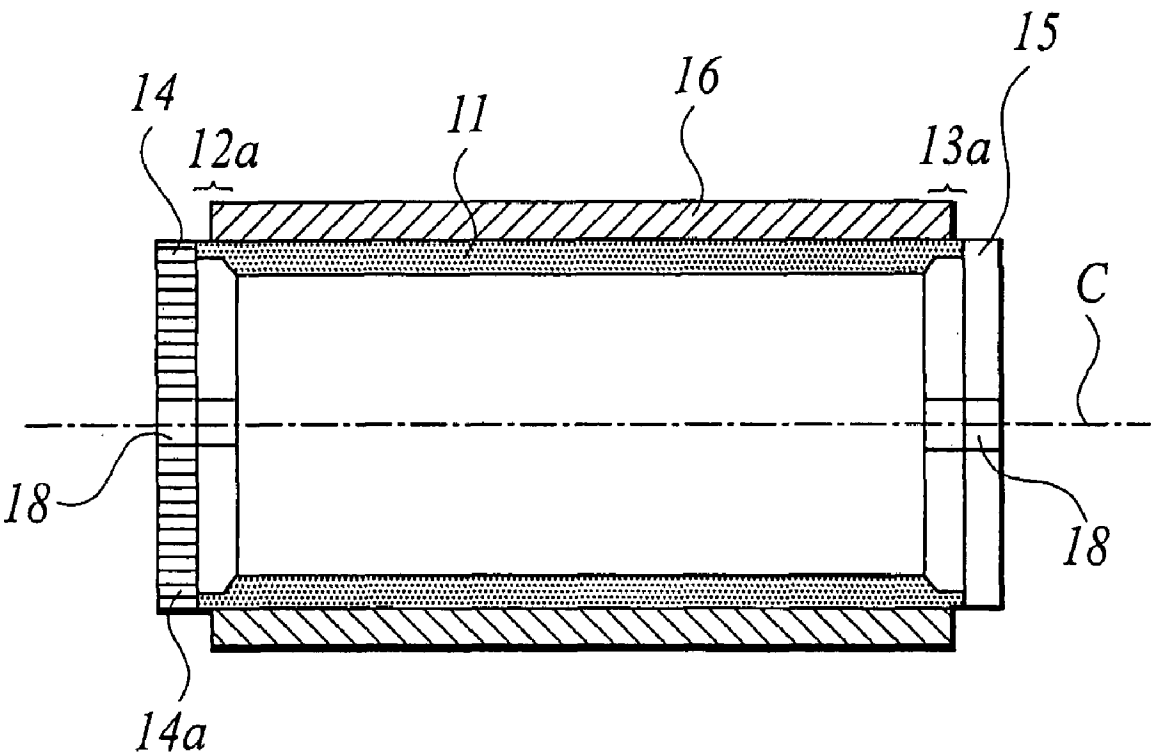
FIG. 4 is a sectional view of a cylindrical substrate, an outer surface of which a photosensitive layer is applied.

The outer surface of the substrate 11 is then washed and applied with a photosensitive coating to form the photosensitive layer 16 as shown in FIG. 4.

Thereafter, the flanges 14, 15 are attached to the substrate 11 having a photosensitive layer coated. Each of the flanges 14, 15 is in the form of a disk having an outer section serving as a lid and having an outer diameter nearly equal to that of the cylindrical substrate 11, and an inner section having an outside diameter smaller than that of the outside section. At the center of the disk, a bore 28 is formed. The outside diameter of the inner section is equal to or slightly larger than the inside diameter of the thin wall portions 12*a* 13*a*. Thus, the flanges 14, 15 can be fixedly secured to the substrate 11 with the smaller diameter sections being tightly fitted into the thin wall portions 12*a*, 13*a*. The flanges 14, 15 are thus secured to the respective ends of the cylindrical substrate 11 in a lid like manner. The photoreceptor preferably has a cylindricity of 5 to 40 μm with a center of a shaft C of the cylindrical substrate 11, in the state of the flanges 14, 15 being attached. The flange 14 has a gear 14*a* on a periphery portion. There is formed a bore 18 for fixing the shaft at the central portion of each flange.

Description will be next made of the constitution of the electrophotographic photoreceptor.

The photoreceptor is preferably applied to an organic electrophotographic photoreceptor (also referred to as organic photoreceptor) from the standpoint of costs and environmental acceptability, although it can be applied to an inorganic photoreceptor using selenium or amorphous silicon. The organic photoreceptor as used herein is intended to refer to a photoreceptor using an organic compound given at least one of charge transport function and charge generation function which are indispensable for constituting an electrophotographic photoreceptor. The organic photoreceptor includes any customarily employed organic photoreceptor using an organic charge transport material or an organic charge generation material, or using a polymeric complex material having both charge transport and generation functions.

Although the layer structure of the organic photoreceptor is not limited, the photosensitive layer may be preferably a laminate of a charge generating layer and a charge transportring layer or a single layer having both charge transport and generation functions. A protecting layer may be preferably provided over the photosensitive layer.

Cylindrical Substrate

In the invention, a drum of metal such as aluminum or nickel may be suitably used as the cylindrical substrate. The specific electric resistively of the cylindrical substrate is preferably not more than $10^3$ Ωcm at room temperature.

Interlayer

In the invention, an interlayer having a barrier function may be interposed between the electrically conductive substrate and the photosensitive layer.

In the invention, the interlayer (including an undercoat layer) may be also formed for the purpose of improving the adhesion between the electrically conductive substrate and the photosensitive layer or for minimizing charge injection from the substrate. Examples of the material of the interlayer include polyamide resins, vinyl chloride resins, vinyl acetate resins, and copolymer resins comprising at least two repeating units of these resins. Of these subbing resins, polyamide resins are preferable as the resins which are capable of minimizing an increase in residual potential accompanied under repeated use. Further, the thickness of the interlayer comprised of these resins is preferably between 0.01 and 0.5 μm.

It is particularly preferred that the interlayer be comprised of a hardenable metal resin obtainable by thermally hardening an organic metal compound such as a silane coupling agent or a titanium coupling agent. The thickness of the interlayer comprised of the hardenable metal resin is preferably between 0.1 and 2 μm.

Photosensitive Layer

In the structure of a photoreceptor, the photosensitive layer preferably has a layered structure including a charge generating layer (CGL) and a charge transporting layer (CTL), although a single structure photosensitive layer having both of the charge generation function and the charge transport function may be used. An increase of the remaining potential accompanied with repetition of the use can be inhibited and another electrophotographic property can be suitably controlled corresponding to its purpose due to the separation the functions of the photosensitive layer into the charge generation and the charge transport. In the photoreceptor to be negatively charged, it is preferable that the CGL be provided on a subbing layer and the CTL be further provided on the CGL. In the photoreceptor to be positively charged, the order of the CGL and CTL in the negatively charged photoreceptor may be reversed. The most preferable photosensitive layer structure is the structure of the photoreceptor to be negatively charged having the function separated structure.

The photosensitive layer of the function separated negatively charged photoreceptor will be described in detail below.

Charge Generation Layer

The charge generation layer contains one or more charge generation materials (CGM). Other materials such as a binder resin and additives may be contained if desired.

Any conventional CGM may be suitably used for the purpose of the invention. Examples of usable CGM include a phthalocyanine pigment, an azo pigment, a perylene pigment and an azulenium pigment. Among them, the CGM having a steric and potential structure capable of taking a stable intermolecular aggregated structure can strongly inhibit the increasing of the remaining potential accompanied with the repetition of use. Specifically, examples of such the CGM include a phthalocyanine pigment and a perylene pigment each having a specific crystal structure. For example, a titanylphthalocyanine having the maximum peak of Bragg angle 2θ of Cu—Kα ray at 27.2° and a benzimidazoleperylene having the maximum peak of Bragg angle 2θ of Cu—Kα ray at 12.4° as the CGM are almost not deteriorated by the repetition of use and the increasing of the remaining potential is small.

A known binder can be used in the charge generation layer as the dispersion medium of the CGM. Examples of the most preferable resin include a formal resin, butyral resin, a silicone resin, a silicon-modified butyral resin and a phenoxy resin. The charge generation material is preferably used in an amount of 20 to 600 parts by mass per 100 parts by mass of the binder resin. By the use of such a resin, an increase of the remaining potential accompanied with the repetition of use can be minimized. The thickness of the charge generation layer is preferably from 0.01 μm to 2 μm.

Charge Transport Layer

The charge transport layer contains a charge transport material (CTM) and a layer-formable binder resin in which the CTM is dispersed. An additive such as an antioxidant may be further contained if desired.

Any customarily employed CTM may be used for the purpose of the invention. For example, a triphenylamine derivative, a hydrazone compound, a styryl compound, a benzizine benzyl compound and a butadiene compound may be used as the CTM. These charge transport material are usually dissolved in a suitable binder resin to form a layer. Among them, the CTM capable of minimizing the increasing of the remaining potential accompanied with repetition of use is one having a high electron mobility, and the difference in the ionization potential between the CTM and the CGM to be used in combination with the CTM is preferably not more than 0.5 (eV), more preferably not more than 0.25 (eV).

The ionization potential of the CGM and CTM is measured by a surface analyzer AC-1 (manufactured by Riken Keiki Co., Ltd.).

Examples of the resin to be used for CTL include a polystyrene, an acryl resin, a methacryl resin, a vinyl chloride resin, a vinyl acetate resin, a poly(vinyl butyral) resin, an epoxy resin, a polyurethane resin, a phenol resin, a polyester resin, an alkyd resin, a polycarbonate resin, a silicone resin, a melamine resin, a copolymer containing two or more kinds of the repeating unit contained the foregoing resins, and a high molecular weight organic semiconductive material such as poly(N-vinylcarbazole) other than the foregoing insulating resins.

Above all, the polycarbonate resin is most preferable as the binder for CTL. The polycarbonate resin is most preferable since the resin simultaneously improves the dispersing ability of the CTM and the electrophotographic property. The ratio of the binder resin to the charge transport material is preferably from 10 to 200 parts by mass to 100 parts by mass of the binder resin, and the thickness of the charge transport layer is preferably from 10 to 40 μm.

A coating method such as an immersion coating, a spray coating and coating by a coating amount controlling circular coating means may be used for preparing the inventive photoreceptor. Especially, the coating by the coating amount controlling circular coating method is preferably used so as to inhibit dissolution of the under layer as small as possible and to attain uniform coating. Accordingly, an electrophotographic photoreceptor having a cylindrical substrate with the roundness maintained. The coating amount controlling circular coating means is described in JP-Tokukaisho-58-189061A.

Description will be next made of the toner used in the invention.

The toner is preferably in the form of mono-dispersed or nearly mono-dispersed particles. The ratio (Dv50/Dp50) of a 50% volume particle diameter (Dv50) to a 50% number particle diameter (Dp50) can be 1.0 to 1.15, preferably 1.0 to 1.13. By employing these ranges, high quality image can be obtained.

The ratio (Dv75/Dp75) of a cumulative 75% volume particle diameter from the largest particle diameter of the toner particle (Dv75) to a cumulative 75% number particle diameter from the largest particle diameter of the toner (Dp75) can be 1.1 to 1.20. By employing the ratio range, small particle diameter components can be eliminated so as not to cause an increase of weakly charged components, formation of inversely charged toners and formation of excessively charged components. As a consequence, the resolution and cleaning efficiency will be deteriorated to cause image defects such as unevenness of a halftone image.

The toner particles having a particle diameter of 0.7× Dp50 or less accounts for 10% by number or less of a total number of the toner particles is preferable. When the amount of the toner particles having a particle diameter of 0.7×Dp50 or less is this range, small particle diameter components can be eliminated so as not to cause an increase of weakly charged components, formation of inversely charged toners and formation of excessively charged components. As a consequence, the resolution and cleaning efficiency will be deteriorated to cause image defects such as unevenness of a halftone image.

In the invention, since an electrostatic latent image formed on a cylindrical electrophotographic photoreceptor having a cylindricity of 5 to 40 μm is developed with a developer containing the above toner having the specific particle distribution characteristics, the resolution and cleaning efficiency are improved so that clear and sharp electrophotographic images free of unevenness of halftone image portions can be obtained.

A cleaning failure is apt to be caused with a photoreceptor having a high cylindricity. This results in a reduction of resolution and unevenness of halftone images. However, when the latent image formed on the photoreceptor is developed with a developer containing such toner having the specific particle distribution characteristic, clear, sharp images free of the above defects may be obtained.

The 50 percent volume particle diameter (Dv50) is preferably from 2 to 8 μm, more preferably from 3 to 7 μm. By adjusting the diameter to the above range, it is possible to enhance resolution. By adjusting Dv50/Dp50 and Dv75/Dp75 to the specified values as well as by adjusting Dv50 to such a value, it is possible to reduce the portion of toner particles having a minute particle diameter, even though the toner is containing particles having a relatively small diameter, and it is possible to improve cleaning properties and toner transferring rate over an extended period of time, thereby forming stable images that are clear and sharp.

In the invention, the cumulative 75 percent volume particle diameter (Dv75) from the largest particle and the cumulative 75 number particle diameter (Dp75) from the largest particle, as described herein, refer to the volume particle diameter and the number particle diameter at the position of the particle size distribution which show 75 percent of the cumulative frequency with respect to the sum of the volume and the sum of the number from the largest particle.

In the invention, the 50 percent volume particle diameter (Dv50), 50 percent number particle diameter (Dp50), cumulative 75 percent volume particle diameter (Dv75), and cumulative 75 percent number particle diameter (Dp75) may be determined by measurement with a Coulter Counter Type TAII or a Coulter Multisizer (both are manufactured by Coulter Inc.).

The proportion of toner particles having a diameter of 0.7×Dp50 or less is 10 percent by number. The amount of such small particle toner may be measured employing an Electrophoretic Light Scattering Spectrophotometer ELS-800, manufactured by Otsuka Electronics Co., Ltd.

In the technical field of the invention in which electrostatic latent images are visualized employing dry system development, as an electrostatic image developing toner employed are those which are prepared by adding an external additive to color particles (mother toner particles) containing at least a colorant and a binder resin. However, as long as specifically there occur no problems, it is generally described that the color particles are not differentiated from the electrostatic latent image developing toner. In the invention, the particle diameter and particle size distribution of the differentiate result in the same measurement values.

The particle diameter of external additive is in an order of nm in terms of the number average primary particle. It is possible to determine the diameter employing an Electrophoretic Light Scattering Spectrophotometer "ELS-800" (manufactured by Otsuka Electronics Co., Ltd.).

The constitution and production method of the toner having the above described particle size distribution will now be described in detail below.

<Toner>

It is preferable to use a coalesced type toner which is prepared by salting out and fusing resinous particles comprising a release agent and colorant particles.

The use of such a toner makes it possible to prepare toners having the above described particle size distribution, and to prepare toner particles which exhibit uniform surface properties of each particle, so that the effects of the invention are exhibited without degrading transferability.

The "salting-out/fusion", as described above, refers to simultaneous occurrence of salting-out (aggregation of particles) and fusion (disappearance of the boundary surface among particles) or an operation to render salting-out and fusion to occur simultaneously. In order to render salting-out and fusion to occur simultaneously, it is necessary to aggregate particles (resinous particles and colorant particles) at temperatures higher than or equal to the glass transition temperature (Tg) of resins constituting the resinous particles.

<Releasing Agent>

The releasing agent employed for the purpose of the invention is not specifically limited. However, it is preferred that a crystalline ester compound (hereinafter named "specific ester compounds") of the following formula (1) be used as the releasing agent:

$$R_1—(OCO—R_2)_n \qquad \text{General Formula (1)}$$

($R_1$ and $R_2$ each represent a hydrocarbyl group having 1 to 0.40 carbon atoms, which may have a substituent and n is an integer from 1 to 4.)

<Specific Ester Compounds>

In the general formula (1) of the specific ester compounds, R1 and R2 each represent hydrocarbyl group which may have a substituent.

The hydrocarbyl group $R_1$ preferably has from 1 to 20 carbon atoms, more preferably from 2 to 5 carbon atoms.

The hydrocarbyl group $R_2$ preferably has from 16 to 30 carbon atoms, more preferably from 18 to 26 carbon atoms.

In the general formula (1), the integer n is preferably from 2 to 4, more preferably 3 or 4 and particularly 4.

The specific ester compound may be synthesized by a dehydration condensation reaction of an alcohol compound and a carbonic acid.

Especially preferable example of the specific ester compound is pentaerthritoltetrabehanate.

Examples of the specific ester compound include those represented by the following formulas 1) to 22):

<Content of the Releasing Agent>

The amount of the releasing agent in the toner is generally from 1 to 30 percent by mass, preferably from 2 to 20 percent by mass, particularly preferably from 3 to 15 percent by mass.

<Resinous Particles Comprising Releasing Agent>

In the invention, the "resinous particles containing a releasing agent" may be obtained as latex particles by dissolving the releasing agent in a monomer to obtain a binding resin, and then dispersing the resulting monomer solution into water based medium, and subsequently polymerizing the resulting dispersion.

The weight average particle diameter of the resinous particles is preferably 50 to 2,000 nm.

Examples of the polymerization method employed to obtain resinous particles, in which binding resins comprise releasing agents, include granulation polymerization methods such as an emulsion polymerization method, a suspension polymerization method, a seed polymerization method, and the like.

The following method (hereinafter referred to as an "mini-emulsion method") may be mentioned as a preferable polymerization method to obtain resinous particles comprising releasing agents. A monomer solution, which is prepared by dissolving releasing agents in monomers, is dispersed into a water based medium prepared by dissolving surface active agents in water at a concentration of less than the critical micelle concentration so as to form oil droplets in water, while utilizing mechanical energy. Subsequently, water-soluble polymerization initiators are added to the resulting dispersion and the resulting mixture undergoes radical polymerization. Further, instead of adding the water-soluble polymerization initiators, or along with the water-soluble polymerization initiators, oil-soluble polymerization initiators may be added to the monomer solution.

A dispersing device for forming an oil droplets in water dispersion, utilizing mechanical energy, is not particularly limited, and may be, for example, a stirrer "CLEARMIX" (produced by M-Technic Co., Ltd.) provided with a high speed rotor, ultrasonic dispersing device, a mechanical homogenizer, a Manton-Gaulin homogenizer, a pressure type homogenizer, and the like. Further, the diameter of dispersed particles is generally 10 to 1,000 nm, and is preferably 30 to 300 nm.

<Binder Resin>

The binder resin, which constitutes the toner of the invention, is preferably a resin which comprises high molecular weight components having a peak, or a shoulder, in the region of 100,000 to 1,000,000, as well as low molecular weight components having a peak, or a shoulder, in the region of 1,000 to 20,000 in terms of the molecular weight distribution determined by GPC.

A method for measuring the molecular weight of resins, employing GPC, is as follows. Added to 1 ml of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.45 to 0.50 μm, the filtrate is injected in a GPC.

Measurement conditions of GPC are described below. A column is stabilized at 40° C., and THF is flowed at a rate of 1 ml per minute. Then measurement is carried out by injecting approximately 100 μl of the sample at a concentration of 1 mg/ml. It is preferable that commercially available polystyrene gel columns are combined and used. For example, it is possible to cite combinations of Shodex GPC KF-801, 802, 803, 804, 805, 806, and 807, produced by Showa Denko Co., Ltd. combinations of TSKgel G1000H, G2000H, G3000H, G4000H, G5000H, G6000H, G7000H, TSK guard column, produced by Tosoh Co., Ltd. As a detector, a refractive index detector (IR detector) or a UV detector is preferably employed. When the molecular weight of samples is measured, the molecular weight distribution of the sample is calculated employing a calibration curve which is prepared employing monodispersed polystyrene as standard particles. Approximately ten polystyrene samples are preferably employed for determining the calibration curve.

The composition materials of resinous particles and the preparation method (polymerization method) thereof will now be described.

[Monomer]

Of polymerizable monomers which are employed to prepare resinous particles, radical polymerizable monomers are essential components, and if desired, crosslinking agents may be employed. Further, at least one of the radical polymerizable monomers having an acidic group or radical polymerizable monomers having a basic group, described below, is preferably incorporated.

(1) Radical Polymerizable Monomers

Radical polymerizable monomers are not particularly limited. It is possible to employ conventional radical polymerizable monomers known in the art. Further, they may be employed in combination of two or more types so as to satisfy desired properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers and halogenated olefin monomers.

As the aromatic vinyl monomer, there may be mentioned, for example, styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne and 3,4-dichlorostyrene.

As the acrylic acid ester bases monomers and methacrylic acid ester monomers, there may be mentioned, for example, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate and diethyl aminoethyl methacrylate.

Examples of the vinyl ester based monomer include vinyl acetate, vinyl propionate and vinyl benzoate.

Examples of the vinyl ether based monomer include vinyl methyl ether, vinyl ethyl ether, vinyl isobutyl ether and vinyl phenyl ether.

Examples of the monoolefin based monomer include ethylene, propylene, isobutylene, 1-butene, 1-pentene and 4-methyl-1-pentene.

Examples of the diolefin based monomer include butadiene, isoprene and chloroprene.

Examples of the halogenated olefin based monomer include vinyl chloride, vinylidene chloride and vinyl bromide.

(2) Crosslinking Agent

A radical polymerizable crosslinking agent may be used to improve the desired properties of toner. Examples of the radical polymerizable crosslinking agent include those having at least two unsaturated bonds such as divinylbenzene, divinylnaphthalene, divinyl ether, diethylene glycol methacrylate, ethylene glycol dimethacrylate, polyethylene glycol dimethacrylate and diallyl phthalate.

(3) Radical Polymerizable Monomers having an Acidic Group or a Basic Group

As radical polymerizable monomers having an acidic group or a basic group, there may be mentioned, for example, amine based compounds such as monomers having a carboxyl group, monomers having a sulfonic acid group, and amine based compounds such as primary, secondary, and tertiary amines and quaternary ammonium salts.

The radical polymerizable monomer having an acidic group may be a monomer having a carboxyl group, such as acrylic acid, methacrylic acid, fumaric acid, maleic acid, itaconic acid, cinnamic acid, monobutyl maleate or monooctyl maleate.

Examples of the monomers having sulfonic acid include styrenesulfonic acid, allylsulfosuccinic acid and octyl allylsulfosuccinate.

The above monomers may be in the form of salts of alkali metals such as sodium or potassium, or salts of alkali earth metals such as calcium.

As the radical polymerizable monomer having a basic group, there may be mentioned amine based compounds Examples of the amine compound include dimethylaminoethyl acrylate, dimethylaminoethyl methacrylate, diethylaminoethyl acrylate, diethylaminoethyl methacrylate, and quaternary ammonium salts of these four compounds; 3-dimethylaminophenyl acrylate, 2-hydroxy-3-methacryloxypropyl-trimethylammonium salt; acrylamide, N-butylacrylamide, N,N-dibutylacrylamide, piperidylacrylamide, methacrylamide, N-butylmethacrylamide, N-octadecylacrylamide; vinylpyridine; vinylpyrrolidone; vinyl N-methylpyridinium chloride, vinyl N-ethylpyridinium chloride, N,N-diallylmethylammonium chloride and N,N-diallylethylammonium chloride.

The amount of the radical polymerizable monomer having an acidic group or a basic group is preferably 0.1 to 15 percent by mass based on a total weight of the monomers, although the range is dependent on the characteristic. The amount of the radical polymerizable crosslinking agent is preferably 0.1 to 10 percent by mass based on a total weight of the radical polymerizable monomers.

[Chain Transfer Agent]

For the purpose of regulating the molecular weight of resinous particles, it is possible to employ a customarily used chain transfer agent. The chain transfer agent is not particularly limited. Examples of the chain transfer agent include mercaptans such as octylmercaptan, dodecylmercaptan and tert-dodecylmercaptan, mercaptopropionates such as n-octyl-3-mercaptopropionate, carbon tetrabromide, and styrene dimer.

[Polymerization Initiator]

A radical polymerization initiator may be suitably employed in the invention, as long as it is water-soluble. Examples of the polymerization initiator include persulfate salts (e.g. potassium persulfate and ammonium persulfate), azo based compounds (4,4'-azobis-4-cyanovaleric acid and salts thereof and 2,2'-azobis(2-amidinopropane) salts) and peroxides.

Further, if desired, it is possible to employ the radical polymerization initiators as redox based initiators by combining them with reducing agents. By employing the redox based initiators, it is possible to increase polymerization activity and decrease polymerization temperature so that a decrease in polymerization time is expected.

The polymerization temperature is not specifically limited, as long as it is higher than the lowest radical formation temperature of the polymerization initiator. For example, the temperature range of 50 to 90° C. is employed. However, by employing a combination of polymerization initiators such as hydrogen peroxide-reducing agent (ascorbic acid and the like), which is capable of initiating the polymerization at room temperature, it is possible to carry out polymerization at least room temperature.

[Surface Active Agent]

In order to perform polymerization employing the aforementioned radical polymerizable monomers, it is preferable to conduct oil droplet dispersion in a water based medium employing a surface active agent. Surface active agents, which are employed for the dispersion, are not particularly limited, and it is possible to cite ionic surface active agents described below as suitable ones.

Examples of the ionic surface active agent include sulfonic acid salts (sodium dodecylbenzenesulfonate, sodium arylalkyl polyethersulfonate, sodium 3,3-disulfondiphenylurea-4,4-diazo-bis-amino-8-naphthol-6-sulfonate, sodium ortho-caroxybenzene-azo-dimethylaniline, 2,2,5,5-tetramethyl-triphenylmethane-4,4-diazi-bis-β-naphthol-6-sulfonate) and sulfuric acid ester salts (sodium dodecylsulfonate, sodium tetradecylsulfonate, sodium pentadecylsulfonate and sodium octylsulfonate), fatty acid salts (sodium oleate, sodium laureate, sodium caprate, sodium caprylate, sodium caproate, potassium stearate and calcium oleate).

Further, a nonionic surface active agent may also be employed. Examples of the nonionic surface active agent include polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids and sorbitan esters.

<Colorant>

As a colorant which constitutes the toner of the invention, there may be used an inorganic pigment, an organic pigment or a dye.

The inorganic pigment may be one which is conventionally known in the art. Specific examples of the inorganic pigment are exemplified below.

As a black pigment such as carbon black (e.g. furnace black, channel black, acetylene black, thermal black and lamp black), and in addition, magnetic powders such as magnetite and ferrite.

If desired, the inorganic pigment may be employed individually or in combination of a plurality of these. Further, the added amount of the pigments is generally between 2 and 20 percent by mass, preferably between 3 and 15 percent by mass, based on the polymer.

When the toner is employed as a magnetic toner, it is possible to add magnetite. In that case, from the viewpoint of providing specified magnetic properties, the magnetite is incorporated into the toner preferably in an amount of 20 to 60 percent by mass.

As the organic pigment and dye, publicly know ones may be employed. Specific examples of the organic pigments and dyes are exemplified below.

Examples of magenta and red pigments include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 222.

Examples of orange and yellow pigments include C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment yellow 180, C.I. Pigment Yellow 185, C.I. Pigment Yellow 155 and C.I. Pigment Yellow 156.

Examples of the green and cyan pigments include C.I. Pigment Blue 15, C.I. Pigment Blue 15:2, C.I. Pigment Blue 15:3, C.I. Pigment Blue 16, C.I. Pigment Blue 60 and C.I. Pigment Green 7.

Examples of the dye include C.I. Solvent Red 1, 49, 52, 58, 63, 111, 122; C.I. Solvent Yellow 19, 44, 77, 79, 81, 82, 93, 98, 103, 104, 112, 162; C.I. Solvent Blue 25, 36, 60, 70, 93 and 95. Further these may be employed in combination as a mixture.

These organic pigments and dyes may be employed individually or in combination of selected ones, if desired. The amount of the pigment is generally between 2 and 20 percent by mass, preferably between 3 and 15 percent by mass, based on the polymer.

The colorant may also be employed after being subjected to surface modification. As the surface modifying agent, those conventionally known in the art may be used. Specific examples of the modifying agent include silane coupling agents, titanium coupling agents and aluminum coupling agents.

<External Additive>

For the purpose of improving fluidity as well as chargeability, and of enhancing cleaning properties, the toner of the invention may be employed in conjunction with a so-called external additive. The external additive is not particularly limited, and various types of fine inorganic particles, fine organic particles, and lubricants may be employed.

The fine inorganic particles may be those conventionally known in the art. Specific examples of the inorganic particles include silica, titanium and alumina particles. These fine inorganic particles are preferably hydrophobic. Specific examples of commercially available fine silica particles include R-805, R-976, R-974, R-972, R-812, and R-809 manufactured by Nippon Aerosil Co.; HVK-2150 and H-200 manufactured by Hoechst Co.; TS-720, TS-530, TS-610, H5, and MS5 manufactured by Cabot Corp.

Specific examples of commercially available fine titanium particles include T-805 and T-604 manufactured by Nippon Aerosil Co.; MT-100S, MT-100B, MT-500BS, MT-600, MT-600SS and JA-1 manufactured by Teika Co.; TA-300SI, TA-500, TAF-130, TAF-510 and TAF-510T manufactured by Fuji Titan Co.; and IT-S, IT-OA, IT-OB and IT-OC manufactured by Idemitsu Kosan Co.

Specific examples of commercially available fine alumina particles include RFY-C and C-604 manufactured by Nippon Aerosil Co.; and TTO-55 manufactured by Ishihara Sangyo Co.

Further, as fine organic particles, there may be used fine spherical organic particles having a number average primary particle diameter of 10 to 2,000 nm. The organic particles may be those of a homopolymer or copolymer of styrene or methyl methacrylate.

The lubricant may be, for example, a metal salt of a higher fatty acid, such as a salt of stearic acid with a metal such as zinc, aluminum, copper, magnesium or calcium; a salt of oleic acid with a metal such as zinc, manganese, iron, copper or magnesium; a salt of palmitic acid with a metal such as zinc, copper, magnesium or calcium; a salt of linoleic acid with a metal such as zinc or calcium; or a salt of ricinolic acid with a metal such as zinc or calcium.

The amount of the external agent is preferably 0.1 to 5 percent by mass based on the toner.

It is preferred that the toner be a coalesced type toner obtained by salting out/fusing resinous particles comprising releasing agents and colorant particles in a water based medium. By salting out/fusing the resinous particles comprising releasing agents, as described above, a toner is obtained in which the releasing agents are finely depressed. Further, such a toner exhibits stable chargeability in addition to the effects attained by the specific particle diameter distribution characteristics.

In addition, the toner particles have uneven surfaces as from the production stage, and a coalesced type toner is obtained by fusing resinous particles and colorant particles. Therefore, differences in the shape as well as surface properties among toner particles are minimal. As a result, the surface properties tend to be uniform. Thus difference in charging and transferring properties among toner particles tends to be minimized so that it is possible to maintain excellent charging and transferring properties.

<Toner Production Process>

One example of the method for producing the toner of the invention is as follows:

(1) a dissolution process in which a releasing agent is dissolved in a monomer to obtain a monomer solution;
(2) a dispersion process in which the resulting monomer solution is dispersed into a water based medium;
(3) a polymerization process in which the resulting water based dispersion of the monomer solution is subjected to polymerization so that dispersion (latex) of resinous particles comprising the releasing agents is prepared;
(4) a salting-out/fusion process in which the resulting resinous particles and the colorant particles are subjected to salting-out/fusion in a water based medium to obtain coalesced particles (toner particles);
(5) a filtration and washing process in which the resulting coalesced particles are collected from the water based medium employing filtration, and surface active agents and the like are removed from the coalesced particles;
(6) a drying process in which washed coalesced particles are dried; and
(7) an external additive addition process may be optionally included in which an external additives is added to the dried coalesced particles.

[Dissolution Process]

Methods for dissolving releasing agents in monomers are not particularly limited.

The amount of the releasing agent dissolved in the monomer is such that the final toner contains generally 1 to 30 percent by mass, preferably 2 to 20 percent by mass, more preferably 3 to 15 percent by mass, of the releasing agent.

If desired, an oil-soluble polymerization initiator and an oil-soluble components may be incorporated into the monomer solution.

[Dispersion Process]

Methods for dispersing the monomer solution into a water based medium are not particularly limited. However, a method is preferred in which dispersion is carried out employing mechanical energy. The monomer solution is preferably subjected to oil droplet dispersion (essentially an embodiment in a mini-emulsion method), employing mechanical energy, especially into a water based medium prepared by dissolving a surface active agent at a concentration of lower than its critical micelle concentration.

A dispersing device to conduct oil droplet dispersion employing mechanical energy, is not particularly limited. For example, "CLEARMIX", an ultrasonic homogenizer, a mechanical homogenizer, a Manton-Gaulin homogenizer or a pressure type homogenizer may be used. Further, the dispersion diameter is generally 10 to 1,000 nm, preferably 30 to 300 nm.

[Polymerization Process]

Basically, any conventionally known polymerization method, such as an emulsion polymerization method, a suspension polymerization method or a seed polymerization method, may be employed.

One example of the preferred polymerization method is a mini-emulsion method, in which radical polymerization is carried out by adding a water-soluble polymerization initiator to a dispersion obtained by oil droplet dispersing a monomer solution, employing mechanical energy, into a water based medium prepared by dissolving a surface active agent at a concentration lower than its critical micelle concentration.

[Salting-Out/Fusion Process]

In the salting-out/fusion process, a colorant particle dispersion is added to a dispersion containing resinous particles obtained by the polymerization process so that the resinous particles and the colorant particles are subjected to salting-out/fusion in a water based medium.

Further, in the salting-out/fusion process, internal agent particles such as of a charge controlling agent may be fused and adhered together with the resinous particles and the colorant particles.

The water based medium as used herein refers to a medium containing water as a major component (at least 50 percent by mass). Components other than water may include a water-soluble organic solvent. Illustrative of suitable solvents are methanol, ethanol, isopropanol, butanol, acetone, methyl ethyl ketone and tetrahydrofuran. Of these, an alcohol such as methanol, ethanol, isopropanol or butanol in which a resin is not dissolved is preferably used.

The colorant particles employed in the salting-out/fusion process may be prepared by dispersing colorants into a water based medium. Dispersion of the colorant particles may be carried out in a state that the concentration of the surface active agent in water is adjusted to at least critical micelle concentration (CMC).

A dispersing device used to disperse colorant particles is not particularly limited. Examples of the dispersing device include "CLEARMIX", ultrasonic homogenizers, mechanical homogenizers, Manton-Gaulin and pressure type homogenizers, and medium type homogenizers such as sand grinders, Getman mill and diamond fine mills. Further, the surface active agent used in the salting-out/fusion process may be the same as the previously described surfactant.

The colorant particles may be surface-modified. One suitable surface modification method is as follows; colorant particles are dispersed in a solvent, and a surface modifier is added to the resulting dispersion. Subsequently the resulting mixture is heated to start reaction. After completing the reaction, colorant particles are collected by filtration and repeatedly washed with the same solvent. Subsequently, the washed colorant particles are dried to obtain the colorant (pigment) which have been treated with the surface modifier.

The salting-out/fusion process is a process in which a salting-out agent containing an alkaline metal salt and/or an alkaline earth metal salt is added to an aqueous medium containing resinous particles and colorant particles as the coagulant at a concentration higher than the critical aggregation concentration. Subsequently, the resulting aggregation is heated above the glass transition point of the resinous particles so that fusion is carried out while simultaneously conducting salting-out. During this process, an organic solvent which is infinitely soluble in water may be added.

In the alkali metal salt or alkaline earth metal salt employed as a salting-out agent, the alkali metal may be lithium, potassium or sodium, while the alkaline earth metal may be magnesium, calcium, strontium or barium. Of these, potassium, sodium, magnesium, calcium and barium are preferable. The salt may be a chloride, a bromide, an iodide, a carbonate or a sulfate.

Examples of the organic solvent, which is infinitely soluble in water, include methanol, ethanol, 1-propanol, 2-propanol, ethylene glycol, glycerin, or acetone. Of these, preferred are alcohols having not more than 3 carbon atoms, such as methanol, ethanol, 1-propanol and 2-propanol, and specially, 2-propanol is preferable.

In the salting-out/fusion process, it is preferred that the hold-over time after the addition of the salting-out agent be as short as possible. Namely, it is preferred that, after the addition of the salting-out agent, the dispersion containing resinous particles and colorant particles be heated as soon as possible to a temperature higher than the glass transition point of the resinous particles.

The reason for this is not well understood. However, problems occur in which the aggregation state of particles varies depending on the hold-over time after salting out so that the particle diameter distribution becomes unstable and surface properties of fused toner particles fluctuate.

The period of time from the addition of the salting-out agent to the start of heating (hold-over time) is generally not more than 30 minutes, preferably not more than 10 minutes.

The temperature at which the salting-out agent is added is not particularly limited, and is preferably not higher than the glass transition temperature of resinous particles.

Further, in the salting-out/fusion process, it is desired that the temperature be quickly increased by heating. The rate of temperature increase is preferably no less than 1° C./minute. The maximum rate of temperature increase is not particularly limited. However, in view of preventing the formation of coarse grains due to rapid salting-out/fusion, the rate is preferably not more than 15° C./minute.

After the dispersion containing resinous particles and colorant particles has been heated to a temperature higher than the glass transition point, it is important to continue the salting-out/fusion by maintaining the temperature of the dispersion for a specified period of time. Thereby, the growth of toner particles (aggregation of resinous particles as well as colorant particles) and fusion (disappearance of the interface between particles) are effectively proceeded. As a result, it is possible to enhance the durability of the finally obtained toner.

Further, after terminating the growth of coalesced particles, fusion by heating may be continued.

[Filtration and Washing]

In the filtration and washing process, the toner particles are collected by filtration from the toner particle dispersion obtained by the process previously described. In the washing step, adhered materials such as the surface active agent and salting-out agent are removed from the collected toner particles (a caked aggregation).

The filtration method is not particularly limited, and may be a centrifugal separation method, a vacuum filtration method which is carried out employing Nutsche, a filtration method which is carried out employing a filter press.

[Drying Process]

The washed toner particles are then dried in this process.

As a dryer employed in this process, there may be used a spray dryer, a vacuum freeze dryer or a vacuum dryer. Further, a standing tray dryer, a movable tray dryer, a fluidized-bed layer dryer, a rotary dryer or a stirring dryer may also be preferably employed.

It is preferred that the moisture content of the dried toner be not more than 5 percent by mass, more preferably not more than 2 percent by mass.

Further, when the dried toner particles are aggregated due to weak attractive forces among particles, aggregates may be subjected to pulverization treatment. As a pulverization device, there may be used a mechanical pulverization device such as a jet mill, a Henschel mixer, a coffee mill, or a food processor.

[External Additive Addition Process]

In the external additive addition process, an external additive is added to the dried toner particles using a suitable known mixing device such as a turbulent mixer, a Henschel mixer, a Nauter mixer or a V-type mixer.

As described previously, the amount of the toner particles having a diameter of 0.7×Dp50 or less should be 10 percent by number or less. In order to control the toner diameter distribution to fall in this range, it is preferable to reduce the time period for temperature control, that is, to elevate the temperature as fast as possible in the salting-out/fusion stage. The time for elevation is preferably 30 minutes or less, more preferably 10 minutes or less, and the heating rate is preferably 1° C. to 15° C./minute.

Besides the colorant and releasing agent, other materials which provide various functions as toner materials may be incorporated into the toner. Specifically, a charge control agent may be suitably used. These materials may be added employing various methods such as one in which, during the salting-out/fusion stage, the charge control agent is simultaneously added to the resinous particles and colorant particles so as to be incorporated into the toner. Alternatively, the charge control agent may be incorporated into resinous particles.

Any conventionally used charge control agent capable of being dispersed in water may be used for the purpose of the invention. Specific examples of the charge controlling agent include nigrosine based dyes, metal salts of naphthenic acid or higher fatty acids, alkoxyamines, quaternary ammonium salts, azo based metal complexes, salicylic acid metal salts and metal complexes thereof.

<Developer>

The toner may be employed in either a single-component developer or a two-component developer.

In the case of the single-component developer, both a non-magnetic single-component developer and a magnetic single-component developer in which magnetic particles having a diameter of 0.1 to 0.5 μm are incorporated into the toner may be employed.

The toner may be blended with a carrier to form a two-component developer. In this case, as magnetic particles of the carrier, there may be used conventional materials known in the art, for example metals such as iron, ferrite, magnetite, alloys of those metals with aluminum or lead. Specifically, ferrite particles are preferred. The volume average particle diameter of the magnetic particles is preferably 15 to 100 μm, more preferably 25 to 80 μm.

The volume average particle diameter of the carrier can be generally determined employing a laser diffraction type particle size distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute the resin dispersion type carrier, are not particularly limited, and resins known in the art may be employed. For example, listed may be styrene-acryl based resins, polyester resins, fluorine based resins and phenol resins.

<Image Forming Method and Apparatus>

Figure 5:
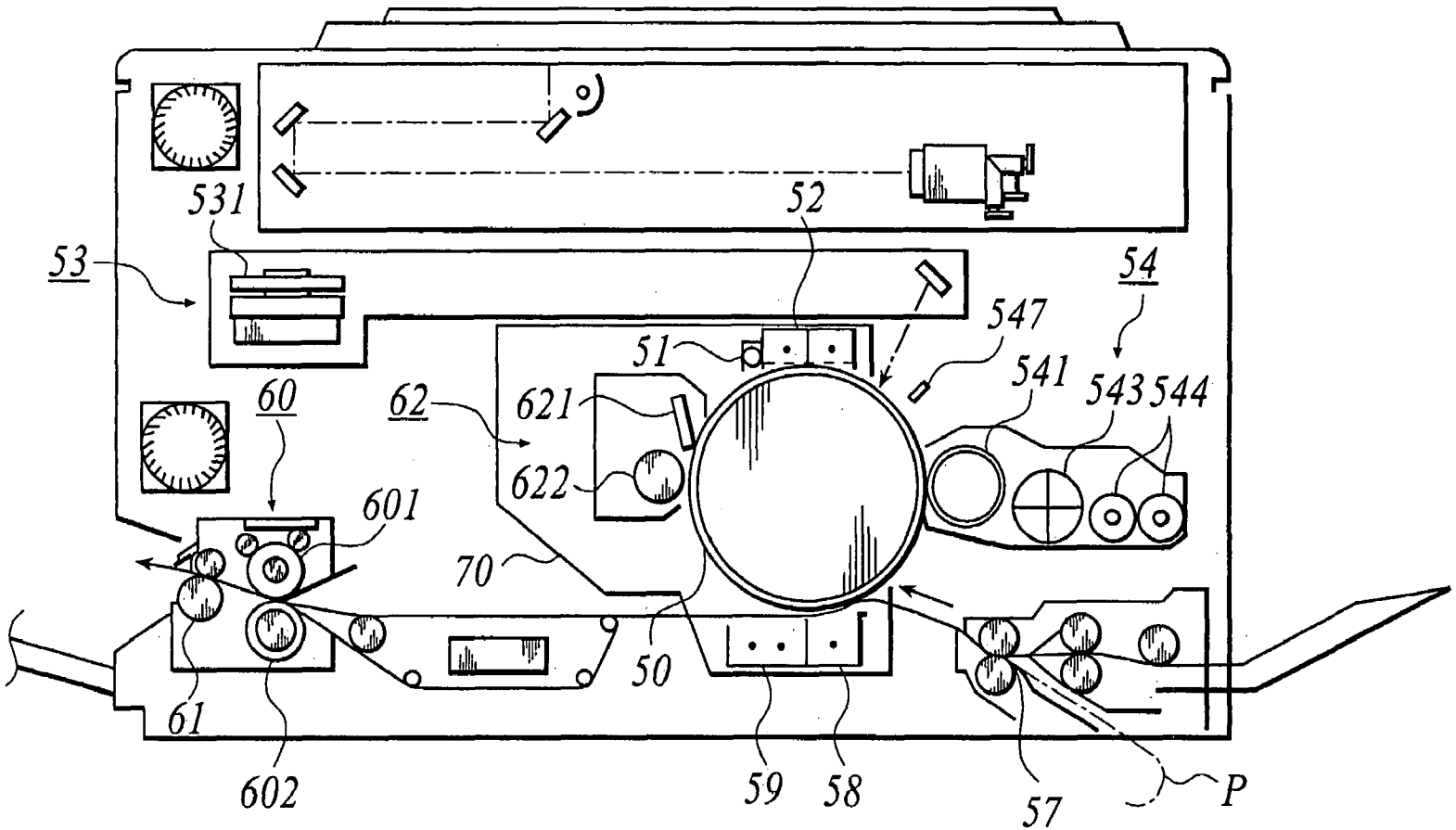
FIG. 5 is a sectional view diagrammatically illustrating an example of an image forming apparatus for carrying out the image forming method according to the invention.

FIG. 5 is a cross-sectional view of an example of an image forming apparatus for embodying the image forming method of the invention.

In FIG. 5, the reference numeral 50 denotes a photoreceptor drum (a photoreceptor) which is an image bearable body. The photoreceptor is prepared by applying an organic photosensitive layer onto the drum, and further by applying a resinous layer onto the resultant photosensitive layer. The drum is grounded and rotated clockwise. Reference numeral 52 is a scorotron charging unit (charging means) which uniformly charges the circumferential surface of photoreceptor drum 50 via corona discharge. Prior to charging, employing the charging unit 52, in order to eliminate the hysteresis of the photoreceptor due to the previous image formation, the photoreceptor surface may be subjected to charge elimination through exposure, employing a pre-charge exposure section 51 comprised of light emitting diodes.

After uniformly charging the photoreceptor, image exposure is carried out based on image signals employing an image exposing unit 53. The image exposing unit 53 comprises a laser diode (not shown) as the exposure light source. Scanning onto the photoreceptor drum is carried out employing light of which light path has been deflected by a reflection mirror 532 through a rotating polygonal mirror 531, fθ lens, and the like, and thus an electrostatic latent image is formed thereon.

The reversal developing process in this invention is an image formation method in which the surface of the photoreceptor is uniformly charged by the charging unit 52, and a portion on which image exposure is carried out, that is, an exposed portion potential of the photoreceptor (image exposed portion) is developed through a developing process (method). A non-image exposed portion is not developed since developing bias potential is applied to the photoreceptor by a developing sleeve 541.

The resultant electrostatic latent image is subsequently developed in the development unit 54. The development unit 54, which stores the developer material comprised of a carrier and a toner, is disposed adjacent to the outer peripheral surface of the photoreceptor drum 50. The development is carried out employing the development sleeve 541, internally comprises magnets and rotates while bearing the developer material on its outer peripheral surface. The interior of the developer unit 54 comprises a developer material stirring member 544, a developer material conveying member 543 and a conveying amount regulating member 542. Thus, the developer material is stirred, conveyed and supplied to the development sleeve. The supply amount is controlled by the conveying amount regulating member 542. The conveyed amount of the developer material varies depending on the linear speed of an applied organic electrophotographic photoreceptor as well as its specific gravity, but is commonly in the range of 20 to 200 mg/cm$^2$.

The developer material comprises a carrier which is prepared by coating insulation resins onto the surface of the aforementioned ferrite as the core, and a toner which is prepared by externally adding an external additive such as silica or titanium oxide, to colored particles comprised of the binder resin, a colorant such as carbon black and a charge controlling agent and which has the specific particle diameter distribution characteristics. The amount of the developer material is regulated employing the conveying amount regulating member, and then conveyed to the development zone, where the latent image developed therewith. At that time, development may be carried out while direct current bias voltage, if desired, alternative current bias voltage is applied to the space between photoreceptor drum 50 and development sleeve 541. In this case, the developer material is subjected to development in a contact or non-contact state with the photoreceptor. The potential of the photoreceptor may be carried out above the developing zone by using a potential sensor 547.

A recording paper P is supplied to the transfer zone by the rotation of paper feeding roller 57, when timing for transfer is properly adjusted.

In the transfer zone, a transfer electrode (transfer section: transferring device) 58 provided adjacent to the peripheral surface of the photoreceptor drum 50 is activated in synchronous with the transferring timing to perform the image transfer onto the recording paper P which has been introduced between the photoreceptor drum 50 and the transfer electrode 58.

Subsequently, the resultant recording paper P is subjected to charge elimination, employing separation electrode (the separation unit) 59 which has been activated almost concurrently with activation of the transfer electrode 58. Thus, the recording paper P is separated from the circumferential surface of photoreceptor drum 50, and conveyed to a fixing unit 60. Then, after the toner is fused under heat and pressure, provided by heated roller 601 as well as pressure contact roller 602, the resulting recording paper P is ejected to the exterior of the apparatus via paper ejection roller 61. Further, after passage of the recording paper P, the transfer electrode 58 and the separation electrode 59 are retracted from the circumferential surface of photoreceptor drum 50, and is prepared for the formation of subsequent toner images. In FIG. 5, a corotron electrode is used as the transfer electrode 58. The operating condition of the transfer electrode varies with the process speed (peripheral speed) of the photoreceptor drum 50 and are not specifically specified. Generally, however, the transfer current is in the range of, for example, +100 to +400 μA, and the transfer voltage is in the range of, for example, from +500 to +2,000 V.

On the other hand, the photoreceptor drum 50, from which recording paper P has been separated, is subjected to removal of any residual toner and cleaning through pressure contact with a blade 621 of a cleaning unit 62, and then subjected to charge elimination by precharge exposure section 51, as well as subjected to charging employing the charging unit 52. The photoreceptor drum 50 then enters the next image forming process.

Reference numeral 70 denotes a detachable process cartridge, which is integrally comprised of the photoreceptor, the charging unit, the transfer unit, the separation unit, and the cleaning unit.

The organic electrophotographic photoreceptor of the invention can generally be applied to electrophotographic apparatuses, laser printers, LED printers, liquid crystal shutter type printers, and the like, and can further be widely applied to apparatuses such as displays, recording media, small volume printing, plate making, facsimile production, and the like, to which common electrophotographic techniques are applied.

EXAMPLES

The following examples will further illustrate the invention. However, the embodiment of the invention is not limited to the examples.

Preparation of Cylindrical Substrate

1. Manufacture of Substrate a. Manufacturing Method of Cylindrical Substrate A-1

Using a contact pressure controlling section 3 shown in FIG. 3, a stainless supporting member (length D=300 mm (0.84×L)) is pressed and held against the inner periphery of a cylindrical substrate (length L=344 mm, outside diameter=100 mm) of aluminum with a thickness of 2.00 mm made by drawing process. Then, the inlay process was carried out with the outside diameter reference to have an inside diameter of 98.40 mm and a length 8 mm from the edge, using a precision CNC both-edge machining device (model BS manufactured by EGURO Inc.).

While the resulting cylinder was supported by a non-slidable chucks, the surface of the cylindrical substrate is machined by a turning process with the inside diameter reference of the inlay processed portion (the turning machine: Model SPA-5 manufactured by Shoun Kosakusho Inc.) to obtain a cylindrical substrate A-1 having a surface roughness Rz (10 points surface roughness) of 0.7 μm and a cylindricity of 8 μm.

Definition of Surface Roughness at 10 Points Rz and Measurement Method Thereof

The surface roughness at 10 points Rz was measured in accordance with JIS B0601-1982 using a reference length of 0.25 mm. Thus, Rz is a difference between an average of the heights of the highest 5 peaks and an average of the depths of the lowest 5 valleys present in a reference length of 0.25 mm of the surface profile.

Rz was measured using a contact surface roughness tester (Surfcorder SE-30D by Kosaka Laboratory Ltd.). Any other tester capable to give same results within an error range may be employed.

b. Manufacturing Method of Cylindrical Substrate A-2

The above procedures for the manufacture of cylindrical substrate A-1 were repeated in the same manner as described except that a supporting member having a length of 214 mm (0.60×L) was used, thereby obtaining a cylindrical substrate A-2 having a 10-point surface roughness Rz of 0.7 μm and a cylindricity of 25 μm.

c. Manufacturing Method of Cylindrical Substrate A-3

The above procedures for the manufacture of cylindrical substrate A-1 were repeated in the same manner as described except that a supporting member having a length of 143 mm (0.40×L) was used, thereby obtaining a cylindrical substrate A-3 having a 10-point surface roughness Rz of 0.7 μm and a cylindricity of 35 μm.

d. Manufacturing Method of Cylindrical Substrate A-4

The above procedures for the manufacture of cylindrical substrate A-1 were repeated in the same manner as described except that a supporting member having a length of 332 mm (0.93×L) was used, thereby obtaining a cylindrical substrate A-4 having a 10-point surface roughness Rz of 0.7 μm and a cylindricity of 28 μm.

e. Manufacturing Method of Cylindrical Substrate B-1

(Gripped from Outside-out of the Invention)

Figure 6:
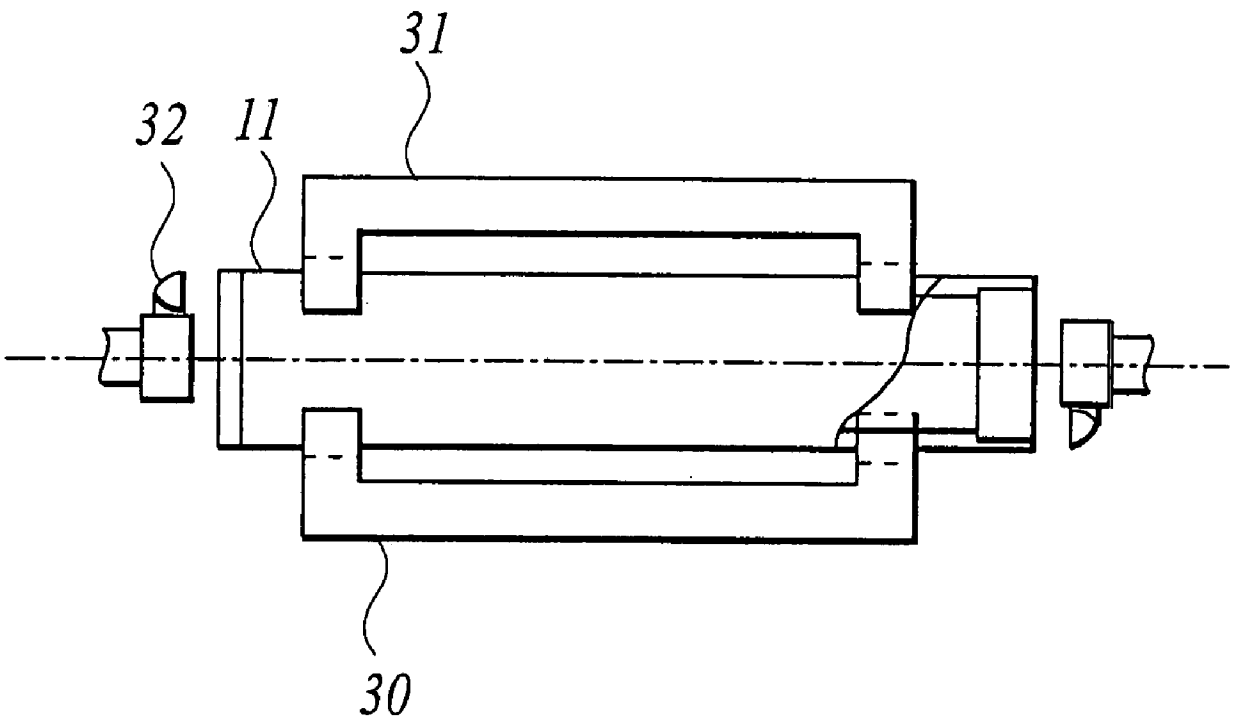
FIG. 6 shows an example of an inlay process in a substrate supported from outside.

The supporting member was not inserted into the cylindrical substrate, but was placed on a gripping member, that is, a fixing V-reception stand 30 from outside as shown in FIG. 6 (an example of the inlay process for the substrate gripped from outside), and then fixed by a pressing V-reception holder 31 on a periphery of the cylindrical substrate 11. Thereafter, the inlay process was performed by rotary drive turning bites 32 (a precision CNC both-edge machining device: model UB-600 manufactured by EGURO Inc.) on both of the right and left sides. Except that, the above procedures for the manufacture of cylindrical substrate A-1 were repeated in the same manner. The cylindrical substrate B-1 obtained has a 10-point surface roughness Rz of 0.7 μm and a cylindricity of 45 μm.

2. Manufacture of Photoreceptor:

The term "parts" represents "parts by mass".

Preparation of Photoreceptor 1

The cylindrical substrate A-3 was washed and applied with an electroconductive coating liquid having a composition shown below to form an electroconductive layer having a thickness of 15 μm (on dry basis).

<Electroconductive Layer (PCL) Composition Liquid>

| | |
|---|---|
| Phenol resin | 160 parts |
| Electronductive titanium oxide | 200 parts |
| Methyl cellosolve | 100 parts |

An undercoat coating liquid having a composition shown below was applied by an immersion coating method to form an undercoat layer (UCL) having a thickness of 1.0 μm.

<Undercoat Layer (UCL) Composition Liquid>

| | |
|---|---|
| Polyamide resin (Amilan CM-8000: manufactured by Toray Corp.) | 60 parts |
| Methanol | 1600 parts |
| 1-butanol | 400 parts |

A charge generation layer coating liquid was prepared by dispersing a composition shown below using a sand mill for 10 hours. The coating composition was coated by means of an immersion coating method on the above-described undercoat layer to form a charge generation layer having a thickness of 0.2 μm on dry basis.

<Charge Generation Layer (CGL) Composition Liquid>

| | |
|---|---|
| Y-type titanyl phthalocyanine | 60 parts |
| Silicone resin solution (KR 5240, 15% xylene butanol solution, manufactured by Shin-Etsu Chemical Co., Ltd.) | 700 parts |
| 2-butanone | 2000 parts |

A charge transport layer coating liquid was prepared by dissolving a composition shown below. The coating composition is applied onto the above-described charge generation layer by a coating amount controlling circular coating device, as described in JP-Tokukaisyo 58-189061, to form a charge transport layer having a thickness of 20 μm, thereby obtaining a photoreceptor 1 having a cylindricity of 35 μm.

<Charge Transport Layer (CTL) Composition Liquid>

| | |
|---|---|
| Charge transport material (N-(4-methylphenyl)-N-{4-(β-phenylstyryl)-phenyl}-p-toluidine) | 200 parts |
| Bisphenol Z type polycarbonate (Eupilon Z300 manufactured by Mitsubishi Gas Chemical Corporation) | 300 parts |
| 1,2-dichloroethane | 2000 parts |

Preparation of Photoreceptor 2

The cylindrical substrate A-4 was washed and applied with an undercoat coating liquid having a composition shown below, followed by drying at 150° C. for 30 minutes to form an undercoat layer having a thickness of 1.0 μm.

<Undercoat Layer (UCL) Composition Liquid>

| | |
|---|---|
| Zirconium chelate ZC-540 manufactured by Matsumoto Seiyaku Co., Ltd.) | 200 parts |
| Silane coupling agent KBM-903 manufactured by Shin-Etsu Kagaku Co., Ltd.) | 100 parts |
| Methanol | 700 parts |
| Ethanol | 300 parts |

A charge generation layer coating liquid was prepared by dispersing a composition shown below using a sand mill for 10 hours. The coating composition is coated by means of an immersion coating method on the above-described undercoat layer to form a charge generation layer having a thickness of 0.2 μm.

<Charge Generation Layer (CGL) Composition Liquid>

| | |
|---|---|
| Y-type titanyl phthalocyanine | 60 parts |
| Silicone resin solution (KR 5240, 15% xylene butanol solution, manufactured by Shin-Etsu Chemical Co., Ltd.) | 700 parts |
| 2-butanone | 2000 parts |

A charge transport layer coating liquid was prepared by dissolving a composition shown below. The coating composition is applied onto the above-described charge generation layer by a coating amount controlling circular coating device to form a charge transport layer having a thickness of 20 μm, thereby obtaining a photoreceptor 2 having a cylindricity of 29 μm.

<Charge Transport Layer (CTL) Composition Liquid>

| | |
|---|---|
| Charge transport material (N-(4-methylphenyl)-N-{4-(β-phenylstyryl)-phenyl}-p-toluidine) | 200 parts |
| Bisphenol Z type polycarbonate (Eupilon Z300 manufactured by Mitsubishi Gas Chemical Corporation) | 300 parts |
| 1,2-dichloroethane | 2000 parts |

Preparation of Photoreceptor 3

An overcoat layer coating liquid was prepared by mixing and dissolving a composition shown below and applied onto the CTL of the photoreceptor 2.

<Overcoat Layer (OCL) Composition Liquid>

A polysiloxane resin (10 parts) having 80 mole % of methylsiloxane units and 20 mole % of methyl-phenylsiloxane units was mixed with 10 parts of molecular sieve 4A, and the resultant mixture was allowed to quiescently stand for 15 hours and then dehydrated. The resultant resin was dissolved in 10 parts of toluene, to which 5 parts of methyltrimethoxysilane and 0.2 part of dibutyl tin acetate were added to prepare a uniform solution. To this solution 6 parts of dihydroxymethyltriphenylamine is added to obtain an overcoat layer coating liquid. The liquid was prepared and applied by the coating amount controlling circular coating device, followed by thermal curing at 120° C. for 1 hour to form an overcoat layer with a thickness of 2 μm, thereby obtaining a photoreceptor 3 having a cylindricity of 30 μm.

Preparation of Photoreceptor 4

The cylindrical substrate A-1 obtained above was washed and applied by an immersion method with the undercoat layer coating liquid to form an undercoat layer having a thickness of 2 μm.

<Undercoat Layer (UCL) Composition Liquid>

The undercoat dispersion liquid was diluted with the same mixing solvent to two parts, then allowed to stand a night and filtrated to obtain an undercoat layer coating liquid. (Filter: manufactured by Nippon Paul Co., RIGIMESH FILTER: nominal filtration accuracy of 5 μm, $5\times10^4$ Pa)

| Undercoat Dispersion Liquid | |
|---|---|
| Polyamide resin CM8000 (produced by Toray Co. Ltd.) | 1 part |
| Titanium oxide SMT500SAS (produced by Teika Co., Ltd., subjected to surface treatment by silica, alumina and methyl hydrogen polysiloxane) | 3 parts |
| Methanol | 10 parts |

The above composition was dispersed for 10 hours using a sand mill in a batch mode to obtain an undercoat layer coating liquid.

The following composition liquids were mixed and dispersed with a sand mill to obtain a charge generation layer coating liquid. The charge generation layer coating liquid was applied by an immersion method to form a charge generation layer having a thickness of 0.3 μm on dry basis onto the above-described undercoat layer.

<Charge Generation Layer (CGL) Composition Liquid>

| | |
|---|---|
| Y type oxytitanyl phthalocyanine (maximum peak angle of X-ray diffraction by character X-ray (CuKα-ray) 2θ = 27.3 degrees) | 20 parts |
| Polyvinyl butyral (#6000-C manufactured by Denki Kagaku Kogyo Co.) | 10 parts |
| t-Butyl acetate | 700 parts |
| 4-Methoxy-4-methyl-2-pentanone | 300 parts |

A charge transport layer coating liquid was prepared by mixing and dissolving a composition shown below. The coating composition was applied onto the above-described charge generation layer using a circular amount controlling type coating device to form a charge transport layer having a thickness of 24 μm, thereby obtaining a photoreceptor 4 having a cylindricity of 15 μm.

<Charge Transport Layer (CTL) Composition Liquid>

| | |
|---|---|
| Charge transport material (N-(4-methylphenyl)-N-{4-(β-phenylstyryl)-phenyl}-p-toluidine) | 75 parts |
| Bisphenol Z type polycarbonate (Eupilon Z300 manufactured by Mitsubishi Gas Chemical Corporation) | 100 parts |
| Methylene chloride | 750 parts |

Preparation of Photoreceptor 5

A photoreceptor 5 was prepared in the same manner as that for photoreceptor 4, except that the cylindrical substrate A-2 was substituted for the cylindrical substrate A-1, thereby obtaining a photoreceptor 5 having a cylindricity of 26 μm.

Preparation of Photoreceptor 6 (Comparative Example 1)

A photoreceptor 6 was prepared in the same manner as that for photoreceptor 4, except that the cylindrical substrate B-1 was substituted for the cylindrical substrate A-1, thereby obtaining a photoreceptor 5 having a cylindricity of 43 μm.

Preparation of Toner and Developer

Example 1 of Preparation of Latex

Into a 5,000 ml separable flask equipped with a stirrer, a temperature sensor, a cooling tube and a nitrogen gas feeder, a solution prepared by dissolving 7.08 g of an anionic surface active agent (sodium dodecylbenzenesulfonate: SDS) in 2,760 g of ion exchanged water was added. The inside temperature was raised to 80° C. under a nitrogen gas flow while stirring at 230 rpm. The compound represented by the aforementioned formula 19 (72.0 g) was added to a monomer mixture comprising 115.1 g of styrene, 42.0 g of n-butyl acrylate and 10.9 g of methacrylic acid. The mixture was then heated at 80° C. to dissolve the solids to obtain a monomer solution.

The heated monomer solution was mixed with and dispersed into the heated surface active agent solution using a mechanical type dispersing device provided with a circulation channel to obtain a dispersion containing emulsified particles having a uniform dispersion particle diameter. Subsequently, a solution prepared by dissolving 0.84 g of a polymerization initiator (potassium persulfate: KPS) in 200 g of ion exchanged water was added to the dispersion, and the resulting mixture was subjected to polymerization at 80° C. for 3 hours with stirring, thereby obtaining latex particles.

Subsequently, a solution prepared by dissolving 7.73 g of the polymerization initiator (KPS) in 240 ml of ion exchanged water was added to the latex particles, to which, after 15 minutes at 80° C., a monomer mixture solution comprising of 383.6 g of styrene, 140.0 g of n-butyl acrylate, 36.4 g of methacrylic acid and 14.0 g of n-octyl 3-mercaptopropionate was added dropwise over 120 minutes. After the dropwise addition, the resulting mixture was subjected to polymerization while stirring for 60 minutes, and then cooled to 40° C., thereby obtaining latex particles (Latex 1).

Preparation of Toner

Preparation of Colored Particles 1Bk

In 160 ml of deionized water were dissolved 9.2 g of sodium n-dodecylsulfate with stirring. While stirring the resulting solution, 20 g of carbon black, "Regal 330R" (produced by Cabot Corp.) were gradually added, and subsequently dispersed employing a stirring unit, "CLEARMIX". The above described dispersion was measured with an electrophoresis light scattering photometer "ELS-800" (produced by OTSUKA ELECTRONICS CO., LTD.) for the particle diameter to reveal that the weight average particle diameter was 112 nm. This dispersion is referred to as "Colorant Dispersion 1".

Into a 5-liter four-necked flask equipped with a temperature sensor, a cooling tube, a nitrogen gas feeder, and a stirrer, 1250 g of "Latex 1" obtained above, 2000 ml of ion exchanged water and "Colorant Dispersion 1" were added to stir. The temperature was increased to 30°, to which 5 mole/l aqueous sodium hydroxide solution was added to adjust the pH to 10.0.

Then, an aqueous solution prepared by dissolving 52.6 g of magnesium chloride tetrahydrate in 72 ml of ion exchanged water was added at 30° C. through 5 minutes. After allowing the resulting mixture to stand as such for 2 minutes, the temperature was increased to 90° through 5 minutes (at a heating rate of 12° C./minute). While maintaining the mixture in this state, the diameter of coalesced particles was measured employing a "Coulter Counter TA-II". When the volume average particle diameter reached 4.3 μm, the growth of particles was terminated by the addition of an aqueous solution prepared by dissolving 115 g of sodium chloride in 700 ml of ion exchanged water. While maintaining the temperature at 85° C.±2° C., the mixture was further stirred for 8 hours to effect salting out/fusion.

Thereafter, the temperature was decreased to 30° C. at a cooling rate of 6° C./minute. Then hydrochloric acid was added to adjust the pH to 2.0, and stirring was terminated. The resulting coalesced particles were collected by filtration, and repeatedly washed. Washed particles were then dried by warm air at 40° C. to obtain colored particles designated as "Colored Particles 1Bk."

Preparation of Colored Particles 2Bk to 11Bk

Colored particles 2Bk to 11Bk were prepared in the same manner as that for Colored Particle 1Bk, except that the production conditions were changed as summarized in Table 1, thereby obtaining Colored Particles 2Bk to 11Bk.

TABLE 1

| COLORED PARTICLE NO. | AMOUNT OF MAGNESIUM CHLORIDE | HEATING RATE | SALTING OUT/FUSION LIQUID TEMPERATURE | SALTING OUT/FUSION HOLDING TIME | PARTICLE DIAMETER WHEN STOPPING GROWTH (μm) |
|---|---|---|---|---|---|
| COLORED PARTICLE 1Bk | 52.6 g | 12° C./MIN | 85 ± 2° C. | 8 HOURS | 4.3 |
| COLORED PARTICLE 2Bk | 52.6 g | 20° C./MIN | 90 ± 2° C. | 6 HOURS | 4.3 |
| COLORED PARTICLE 3Bk | 52.6 g | 5° C./MIN | 90 ± 2° C. | 6 HOURS | 4.1 |
| COLORED PARTICLE 4Bk | 26.3 g | 12° C./MIN | 85 ± 2° C. | 8 HOURS | 4.3 |
| COLORED PARTICLE 5Bk | 78.9 g | 12° C./MIN | 85 ± 2° C. | 8 HOURS | 4.3 |
| COLORED PARTICLE 6Bk | 52.6 g | 12° C./MIN | 85 ± 2° C. | 8 HOURS | 3.5 |
| COLORED PARTICLE 7Bk | 38.6 g | 12° C./MIN | 85 ± 2° C. | 8 HOURS | 3.4 |
| COLORED PARTICLE 8Bk | 78.9 g | 12° C./MIN | 85 ± 2° C. | 8 HOURS | 3.2 |
| COLORED PARTICLE 9Bk | 52.6 g | 12° C./MIN | 85 ± 2° C. | 8 HOURS | 5.6 |
| COLORED PARTICLE 10Bk | 45.8 g | 12° C./MIN | 85 ± 2° C. | 8 HOURS | 6.8 |
| COLORED PARTICLE 11Bk | 52.6 g | 12° C./MIN | 85 ± 2° C. | 8 HOURS | 8.9 |

Colored Particles 1Bk through 11Bk were each mixed with 1% by mass of hydrophobic silica (number average primary particle diameter: 12 nm, degree of hydrophobicity: 68) and 1% by mass of hydrophobic titanium oxide (number average primary particle diameter: 20 nm, degree of hydrophobicity: 63) using a Henschel mixer to obtain Toners 1Bk through 11Bk whose particle diameter distribution characteristics were as shown in Table 2. Toners 1Bk through 11Bk was mixed with a silicone-coated carrier to obtain two-composition Developers 1Bk through 11Bk, respectively.

The average particle diameter and particle distribution characteristics of toners are substantially the same as those of the corresponding colored particles to which the external additive has not yet been mixed.

TABLE 2

| TONER NO. | 50% VOLUME AVERAGE PARTICLE DIAMETER (Dv50) (μm) | 50% NUMBER AVERAGE PARTICLE DIAMETER (Dp50) (μm) | Dv50/Dp50 | CUMULATIVE 75% VOLUME PARTICLE DIAMETER (Dv75) (μm) | CUMULATIVE 75% NUMBER PARTICLE DIAMETER (Dp75) (μm) | Dv75/Dp75 | NUMBER % OF PARTICLES WITH DIAMETER OF 0.7 × Dp50 OR LESS |
|---|---|---|---|---|---|---|---|
| TONER 1Bk | 4.6 | 4.3 | 1.07 | 4.1 | 3.8 | 1.08 | 7.8 |
| TONER 2Bk | 4.8 | 4.5 | 1.07 | 4.2 | 3.7 | 1.14 | 5.5 |
| TONER 3Bk | 4.4 | 4.0 | 1.10 | 4.0 | 3.4 | 1.18 | 8.2 |
| TONER 4Bk | 4.6 | 3.7 | 1.24 | 4.0 | 3.1 | 1.29 | 13.6 |

TABLE 2-continued

| TONER NO. | 50% VOLUME AVERAGE PARTICLE DIAMETER (Dv50) (μm) | 50% NUMBER AVERAGE PARTICLE DIAMETER (Dp50) (μm) | Dv50/Dp50 | CUMULATIVE 75% VOLUME PARTICLE DIAMETER (Dv75) (μm) | CUMULATIVE 75% NUMBER PARTICLE DIAMETER (Dp75) (μm) | Dv75/Dp75 | NUMBER % OF PARTICLES WITH DIAMETER OF 0.7 × Dp50 OR LESS |
|---|---|---|---|---|---|---|---|
| TONER 5Bk | 4.7 | 4.3 | 1.09 | 4.1 | 3.6 | 1.14 | 6.3 |
| TONER 6Bk | 3.5 | 3.1 | 1.13 | 3.1 | 2.8 | 1.11 | 6.8 |
| TONER 7Bk | 3.8 | 3.4 | 1.12 | 3.3 | 2.7 | 1.23 | 12.4 |
| TONER 8Bk | 3.6 | 3.3 | 1.09 | 3.1 | 2.8 | 1.11 | 6.3 |
| TONER 9Bk | 5.8 | 5.3 | 1.09 | 5.1 | 4.5 | 1.13 | 8.4 |
| TONER 10Bk | 7.1 | 6.4 | 1.11 | 6.3 | 5.3 | 1.19 | 11.0 |
| TONER 11Bk | 9.3 | 8.8 | 1.06 | 7.9 | 6.9 | 1.14 | 6.3 |

Evaluation

The Photoreceptors 1 through 6 and Developers 1Bk through 11Bk were combined as shown in Table 3. Each of the combinations was evaluated employing a digital copier Konica "Sitios 7075" manufactured by Konica Corp as a copier for evaluation. The copier was adapted to perform a process including corona charging, laser exposure, reversal development, electrostatic transfer, claw separation blade cleaning and cleaning utilizing a supplementary brush roller and operated at a printing rate of 75 sheets/minute. Cleaning properties and images were evaluated by copying an original document having four equal quarter parts of a text having a pixel ratio of 7 percent, a portrait, a solid white image, and a solid black image, employing A4 neutral paper sheets. The original document was continuously copied employing 200,000 sheets at high temperature and high humidity (30° C. and 80 percent relative humidity) which were assumed to be the severest conditions, and the resulting halftone, solid white images and solid black images were evaluated. Incidentally, prior to initial printing, the photoreceptor was fitted with the cleaning blade by dusting the photoreceptor surface with setting powder. Thereafter, 200,000 copies were produced. Evaluation items as well as evaluation criteria are shown below.

TABLE3

| COMBINATION NO. | PHOTORECEPTOR NO. | CYLINDRICITY OF PHOTORECEPTOR | DEVELOPER NO. (=TONER NO.) |
|---|---|---|---|
| 1 | 4 | 15 | 1Bk |
| 2 | 4 | 15 | 2Bk |
| 3 | 4 | 15 | 3Bk |
| 4 | 4 | 15 | 4Bk |
| 5 | 4 | 15 | 5Bk |
| 6 | 4 | 15 | 6Bk |
| 7 | 4 | 15 | 7Bk |
| 8 | 4 | 15 | 8Bk |
| 9 | 4 | 15 | 9Bk |
| 10 | 4 | 15 | 10Bk |
| 11 | 4 | 15 | 11Bk |
| 12 | 1 | 35 | 2Bk |
| 13 | 2 | 29 | 2Bk |
| 14 | 3 | 30 | 2Bk |
| 15 | 5 | 26 | 2Bk |
| 16 | 6 | 43 | 2Bk |

Evaluation Item and Evaluation Criteria

Image Density: (Measurement was carried out by using a reflection densitometer RD-918 (manufactured by Macbeth Co., Ltd.) in terms of relative reflection density with the reflection density of white paper as "○". Evaluates initial copy and 200,000th copy.)

A: 1.2 or more in both initial and 200,000th copies (excellent)

B: 1.0 or more but less than 1.2 in both initial and 200,000th copies (acceptable in practical use)

C: less than 1.0 in at least one of initial and 200,000th copies (unacceptable in practical use):

Fog: evaluated by a solid white image density

A density of copy paper without having been printed (blank paper) was measured at 20 points for absolute image density using Macbeth reflection densitometer "RD-918" and the average value of the 20 measured values was calculated as a blank density. Next, a white image was copied on a copy paper and the copy was measured at 20 points for absolute image density in the same manner as above (initial copy and 200,000th copy). The difference between the sample density and the blank density was calculated from which the fog was evaluated based on the following ratings.

A: 0.005 or less in both initial and 200,000th copies (excellent)

B: 0.01 or less but greater than 0.005 in both initial and 200,000th copies (acceptable in practical use)

C: greater than 0.01 (unacceptable in practical use)

Resolution: (evaluated based on legibility of character images)

A: No difference in resolution is seen between the image of the initial copy and the image of the 200,000th copy B: Sight deterioration in resolution is seen after the 200,000th copy of half tone image C: Significant deterioration in resolution is seen after 200,000th copy of half tone image Halftone Image Unevenness:

Unevenness of a halftone image was evaluated by measuring a density difference (ΔHD=maximum density−minimum density) of a halftone image (an uniform image having a density of around 0.2) of the 200,000th copy. A density of copy paper without having been printed (blank paper) was measured at 20 points for absolute image density by use of Macbeth reflection densitometer "RD-918" and let the average value be a blank paper density. Next, measurement was carried out in a similar manner at 20 points to determine an absolute image density.

A: ΔHD is 0.05 or less (excellent)

B: ΔHD is greater than 0.05 but less than 0.1 (acceptable in practical use)

C: ΔHD is 0.1 or more (unacceptable in practical use)

Toner Transferability:

Toner removed by the cleaning unit was collected in a bag without being recycled to the developing unit. The toner transferability was calculated according to the following formula:

Toner transferability (%)={1−(amount of toner collected)/(amount of toner consumed)}×100

Transfer Condition:

Corona charging method was used.

Cleaning Condition:

A cleaning blade having a hardness of 70, an impact resiliency of 65%, a thickness of 2 mm and a free length of 9 mm was disposed in a counter direction in pressure contact with the photoreceptor at a linear pressure of 18 N/m using a weight.

The results of evaluation are showing Table 4.

TABLE 4

| COMBI-NATION NO. | IMAGE DENSITY | FOG | RESOLUTION | CLEANING EFFICIENCY | HALFTONE UNEVEN-NESS | TONER TRANSFERABILITY (%) | REMARKS |
|---|---|---|---|---|---|---|---|
| 1 | A | A | A | A | A | 92 | WITHIN THE PRESENT INVENTION |
| 2 | A | A | A | A | A | 94 | WITHIN THE PRESENT INVENTION |
| 3 | A | A | A | A | A | 91 | WITHIN THE PRESENT INVENTION |
| 4 | B | A | C | C | C | 78 | OUTSIDE THE PRESENT INVENTION |
| 5 | A | A | A | A | A | 89 | WITHIN THE PRESENT INVENTION |
| 6 | A | A | A | A | A | 88 | WITHIN THE PRESENT INVENTION |
| 7 | B | A | B | C | B | 83 | OUTSIDE THE PRESENT INVENTION |
| 8 | A | A | A | A | A | 91 | WITHIN THE PRESENT INVENTION |
| 9 | A | A | A | A | A | 92 | WITHIN THE PRESENT INVENTION |
| 10 | A | A | B | C | B | 85 | OUTSIDE THE PRESENT INVENTION |
| 11 | A | A | A | B | A | 92 | WITHIN THE PRESENT INVENTION |
| 12 | B | A | B | A | B | 88 | WITHIN THE PRESENT INVENTION |
| 13 | A | A | A | A | A | 92 | WITHIN THE PRESENT INVENTION |
| 14 | A | A | A | A | A | 89 | WITHIN THE PRESENT INVENTION |
| 15 | A | A | A | A | A | 92 | WITHIN THE PRESENT INVENTION |
| 16 | B | A | B | C | C | 82 | OUTSIDE THE PRESENT INVENTION |

Cleaning Efficiency:

After 100,000 copies had been produced, 10 copies were continuously produced using A3 copy papers. Whether or not cleaning failure occurred was determined by observing the background portions of the 10 copies. Similar measurement was carried out after the production of 200,000 copies. Cleaning efficiency was evaluated according to the following ratings:

A: No cleaning failure (passage of toner particles through the cleaning unit without being removed) was observed even after 200,000 copies B: No cleaning failure (passage of toner particles through the cleaning unit without being removed) was observed after 100,000 copies C: Cleaning failure occurred before 100,000 copies Other Evaluation Conditions:

In the above measurements, the other evaluation conditions using the copier "Sitios 7075" were set as follows.

Charging Condition:

Charging device was a scorotron charger. Initial charge potential was at −750 V.

Exposure Condition:

Exposure amount was set to provide a potential of the exposed area of −150 V.

Development Condition:

DC bias voltage was set at −550 V. The developer used is for toners comprising a carrier having a ferrite core surrounded by a silicone coating, a colorant such as carbon black or the like with styrene-acryl based resins as a main material, a charge control agent, a colorant particle comprised of a low-molecular polyofelin, which is externally added with titanium, alumina or the like.

As will be evident from Table 4, combination Nos. 1–3, 5, 6, 8, 9 and 11–15 in which a cylindrical photoreceptor having a cylindricity of 5 to 40 μm is used in conjunction with a toner having the following specific particle diameter distribution characteristics (a) to (c) exhibit superior image density, resolution, cleaning efficiency, halftone evenness and toner transferability as compared with combination Nos. 4, 7 and 10 which do not meet with the these conditions. Even though the toner used in Combination 16 meets with the above conditions (a)–(c), the cylindrical photoreceptor 6 used has a cylindricity of 43 μm, the resolution, cleaning efficiency, halftone evenness and toner transferability are inferior to the inventive combinations.

(a) The ratio (Dv50/Dp50) of a 50% volume particle diameter (Dv50) to a 50% number particle diameter (Dp50) is 1.0 to 1.15.

(b) The ratio (Dv75/Dp75) of a cumulative 75% volume particle diameter from the largest particle diameter of the toner particle (Dv75) to a cumulative 75% number particle diameter from the largest particle diameter of the toner particle (Dp75) is 1.0 to 1.20.

(c) The toner particles having a particle diameter of 0.7× Dp50 or less accounts for 10% by number or less of a total number of the toner particles.

As has been apparent from the examples described above, in the image forming method meeting the conditions of the invention, the electrophotographic image forming in which a small toner is used can attain good cleaning efficiency and can afford sharp images having good image evenness.

The entire disclosure of JP-Tokukai-2003-186235A which was published on Jul. 3, 2003, including specification, claims, drawings and summary are incorporated herein by reference in its entirety.

What is claimed is:

1. An image forming method comprising: developing a latent image formed on a cylindrical electrophotographic photoreceptor having a cylindricity of 5 to 40 μm, with a developer comprising a toner which comprises a ratio Dv50/Dp50 of a 50% volume particle diameter Dv50 to a 50% number particle diameter Dp50 of 1.0 to 1.15, a ratio Dv75/Dp75 of a cumulative 75% volume particle diameter from a largest volume particle diameter Dv75 to a cumulative 75% number particle diameter from a largest number particle diameter Dp75 of 1.0 to 1.20, and toner particles having a particle diameter of 0.7×Dp50 or less in an amount of 10 percent by number or less.

2. The method of claim 1, wherein the 50% volume particle diameter Dv50 is 2 μm to 8 μm.

3. The method of claim 1, wherein the toner comprises colored particles which are obtained by polymerizing at least polymerizable monomers in an aqueous medium.

4. The method of claim 1, wherein the toner comprises colored particles which are obtained by salting-out/fusing at least resin particles in an aqueous medium.

5. The method of claim 1, wherein the cylindricity is 7 to 30 μm.

6. The method of claim 1, wherein the cylindricity is 7 to 27 μm.

7. The method of claim 1, wherein the ratio Dv50/Dp50 of the 50% volume particle diameter Dv50 to the 50% number particle diameter Dp50 is 1.0 to 1.13.

8. The method of claim 1 comprising:

transferring a toner image formed through development onto a recording medium; and removing a residual toner on the photoreceptor after the transferring.

9. The method of claim 8, wherein the cylindricity is 7 to 30 μm.

10. The method of claim 9, wherein the ratio Dv50/Dp50 of the 50% volume particle diameter Dv50 to the 50% number particle diameter Dp50 is 1.0 to 1.13.

11. The method of claim 10, wherein the 50% volume particle diameter Dv50 is 3–7 μm.

12. The method of claim 11, wherein the toner comprises a crystalline ester compound of the following general formula (1):

$$R_1—(OCO—R_2)_2 \qquad \text{General Formula (1)}$$

wherein $R_1$ and $R_2$ each represent a hydrocarbyl group having 1 to 40 carbon atoms, which may have a substituent, and n is an integer from 1 to 4.

13. The method of claim 8, wherein the cylindricity is 7 to 27 μm.

14. The method of claim 1, wherein the toner comprises a crystalline ester compound of the following general formula (1):

$$R_1—(OCO—R_2)_n \qquad \text{General Formula (1)}$$

wherein $R_1$ and $R_2$ each represent a hydrocarbyl group having 1 to 40 carbon atoms, which may have a substituent, and n is an integer from 1 to 4.

* * * * *